US012434888B2

(12) United States Patent
Wong et al.

(10) Patent No.: US 12,434,888 B2
(45) Date of Patent: Oct. 7, 2025

(54) LID ASSEMBLY AND CONTAINER COMPRISING THE SAME

(71) Applicant: KING'S FLAIR MARKETING LIMITED, Tortola (VG)

(72) Inventors: Siu Wah Wong, Tortola (VG); Fat Sun Kwok, Tortola (VG)

(73) Assignee: KING'S FLAIR MARKETING LIMITED, Tortola (VG)

( * ) Notice: Subject to any disclaimer, the term of this patent is extended or adjusted under 35 U.S.C. 154(b) by 327 days.

(21) Appl. No.: 18/218,354

(22) Filed: Jul. 5, 2023

(65) Prior Publication Data

US 2024/0059461 A1 Feb. 22, 2024

Related U.S. Application Data

(60) Provisional application No. 63/398,646, filed on Aug. 17, 2022.

(51) Int. Cl.

| | |
|---|---|
| ***B65D 47/06*** | (2006.01) |
| ***B65D 47/08*** | (2006.01) |
| ***B65D 47/32*** | (2006.01) |

(52) U.S. Cl.

CPC ..... *B65D 47/065* (2013.01); *B65D 47/0885* (2013.01); *B65D 47/32* (2013.01); *B65D 2547/066* (2013.01)

(58) Field of Classification Search

CPC .. B65D 47/065; B65D 47/0885; B65D 47/32; B65D 2547/066; B65D 51/242; B65D 47/066; B65D 51/1644; A47G 19/2272

See application file for complete search history.

(56) References Cited

U.S. PATENT DOCUMENTS

| | | | | |
|---|---|---|---|---|
| 10,870,521 | B2 * | 12/2020 | Fang | A45F 3/18 |
| 12,035,825 | B2 * | 7/2024 | Sorensen | A47G 19/2266 |
| 2012/0187075 | A1 * | 7/2012 | El-Saden | B65D 51/242 215/389 |
| 2012/0312832 | A1 * | 12/2012 | Lane | B65D 51/242 220/774 |
| 2018/0192800 | A1 * | 7/2018 | Coon | B65D 25/46 |
| 2019/0100362 | A1 * | 4/2019 | Meyers | B65D 47/0885 |
| 2019/0177049 | A1 * | 6/2019 | Farsai | A45F 3/16 |
| 2024/0059461 | A1 * | 2/2024 | Wong | B65D 47/066 |

* cited by examiner

*Primary Examiner* — Bob Zadeh
(74) *Attorney, Agent, or Firm* — WPAT, PC

(57) ABSTRACT

The present invention is related to a lid assembly for a container provided with a first lid; a second lid, removably connected to said first lid; a trigger mechanism, slidably connected to said second lid to slide between a first trigger position and a second trigger position, is provided with a first interaction means and a first engagement means; and a spout, pivotably connected to said second lid, is provided with a second interaction means and a second engagement means, wherein the pivoting movement of said spout is controlled by the operation of said trigger mechanism; characterized in that, said lid assembly is configured to assume a first configuration, a second configuration, and a third configuration.

26 Claims, 40 Drawing Sheets

LID ASSEMBLY AND CONTAINER COMPRISING THE SAME

FIELD OF THE INVENTION

The present invention relates generally to a lid design for use in a container, and in particular an auto-spout lid assembly comprising a spout that can be operated by a trigger, and various lid parts that can be easily disassembled and re-assembled for cleaning purpose. This invention also relates to a container comprising such a lid assembly.

BACKGROUND OF THE INVENTION

Typical beverage container on the market is provided with a lid assembly including a pivotable spout configured to assume a stowed configuration where the spout is positioned downwards and received within the compartment formed by the surrounding wall of the lid assembly, and an open configuration where the spout is outwardly exposed to dispense the beverage. The container containing hot drinks accumulates hot air pressure when the spout is in the stowed configuration. When the spout switches from the stowed configuration to the open configuration, the hot air pressure and hot drinks is quickly ejected out of the spout. Such ejection brings inconvenience to the user, and is more likely to burn the user. Although there are products on the market that have a pressure relief effect when opening a spout of a container, the effect is not desirable as the effect is basically synchronous with the opening of the spout, and there is always a chance to let hot air pressure and hot drinks ejects out of the spout.

In addition, typical lid assembly for container on the market is manufactured as one-piece, which can lead to issues such as difficulty in cleaning and a short lifespan due to the inability to replace damaged or worn-out parts. Although some typical lid assemblies on the market are designed to compose of different individual parts, these parts are mostly fixed. It offers the same forementioned problem as those lid assemblies in one-piece.

To address these problems, or at least provide an alternative, the present invention aims to provide users with a lid in the form of an assembly that realize the controllable release of hot air pressure accumulated inside the container before the spout of container is fully opened, so as to avoid the user being burned by the ejected hot air. Yet further, the present invention aims to provide users with the lid assembly with disassembled parts that can be easily separated. By separating the lid assembly into individual parts, such as an upper lid, a lower lid, a spout, and so on, each part can be cleaned separately, which is essential for hygiene. Moreover, disassembled parts can be conveniently replaced if they become damaged or worn out, which can prolong the lifespan of both the lid assembly and the container it is attached to.

SUMMARY OF INVENTION

The first aspect of the present invention is related to a lid assembly for a container, comprising: a first lid; a second lid, removably connected to said first lid; a trigger mechanism, slidably connected to said second lid to slide between a first trigger position and a second trigger position, is provided with a first interaction means and a first engagement means; and a spout, pivotably connected to said second lid, is provided with a second interaction means and a second engagement means, wherein the pivoting movement of said spout is controlled by the operation of said trigger mechanism; characterized in that, said lid assembly is configured to assume: a first configuration in which said trigger mechanism being at said first trigger position and said spout being at a first spout position, wherein said first engagement means engaging with said second engagement means, and said first interaction means not interacting with said second interaction means; a second configuration in which said trigger mechanism being at said second trigger position and said spout being at a second spout position, wherein said first engagement means not engaging with said second engagement means, and said first interaction means interacting with said second interaction means; or a third configuration in which said trigger mechanism being at said first trigger position and said spout being at a third spout position, wherein said first engagement means not engaging with said second engagement means, and said first interaction means not interacting with said second interaction means.

In one embodiment, said trigger mechanism comprising a first portion and a second portion adapted in a bifurcation form having a pair of legs, at least one of the legs is provided with an actuator cam face defining said first engagement means; and a cam face provided on the lateral side of said spout defining said second engagement means, wherein said actuator cam face and said cam face are on the same side.

Preferably, said second interaction means is provided at the lower portion of said spout; and said first interaction means is provided at said first portion of said trigger mechanism, wherein: said trigger mechanism moving from said first trigger position to said second trigger position enabling said spout starts pivoting from said first spout position until said first interaction means interacting with said second interaction means, thereby said spout being maintained at said second spout position.

In one embodiment, said lid assembly further comprising: a cover, pivotably mounted to said first lid, is provided with a third interaction means; and a switch, movably connected to said second lid and is adjacent or adjacent to said cover, is provided with a fourth interaction means, wherein, said switch is configured to assume: a first position where said third interaction means not interacting with said fourth interaction means; and a second position where said third interaction means interacting with said fourth interaction means.

Preferably, said third interaction means is a cutout adjacent or adjacent to the pivot defined by the connection between said cover and said first lid; and said fourth interaction means is an arm portion of said switch dimensioned to be accommodated by said cutout.

In one embodiment, said second lid is provided with a pair of oppositely facing vertical wall members, at least one of said wall member is provided with a passage; and at least one of said legs of said trigger mechanism is provided with a protrusion positioned and dimensioned corresponding to the position and dimension of said passage of said second lid, such that said trigger mechanism is slidable in said passage between said first trigger position and said second trigger position. Preferably, said passage is a groove or an aperture. More preferably, said lid assembly further comprising a position system enabling the removable connection between said first lid and said second lid, wherein said position system is formed by at least one selected from a group comprising:

- a first protrusion extending along a portion of the inner surface of the circumferential wall of said first lid, collaboratively operating with a first protrusion extending along a portion of the perimeter on the top surface of said second lid;

a leg extending from the bottom side of said first lid, collaboratively operating with a groove on the top surface of said second lid;

a second protrusion on the inner surface of the circumferential wall of said first lid defining an aperture, collaboratively operating with a second protrusion on said vertical wall member of said second lid;

a third protrusion provided to said first lid extending along the height of the circumferential wall to an extent collaboratively operating with a third protrusion at a manipulation end of said vertical wall member of said second lid; and a recess on or adjacent or adjacent to the bottom side of said first lid, collaboratively operating with a fourth protrusion on the top side of said second lid.

Preferably, said manipulation end of said vertical wall member is made of resilient material.

In one embodiment, the spout in said second configuration being positioned 30° to 60° upwards with respect to the spout in said first configuration.

In one embodiment, the spout in said third configuration being formed an angle≥90° with respect to the spout in said first configuration.

In one embodiment, the spout in said third configuration being formed an obtuse with respect to the spout in said first configuration.

In one embodiment, said lid assembly is designed to operate the pivoting of said spout from said first spout position to said second spout position then to said third spout position.

In one embodiment, said second lid is provided with an air channel in fluid communication between the internal cavity of said container and the atmosphere, said air channel is operationally openable and closable with said trigger mechanism.

Preferably, when said trigger mechanism being in the first trigger position, said air channel being closed; and when said trigger mechanism being in the second trigger position, said air channel being opened. More preferably, said channel is operationally opened before said lid assembly assuming said second configuration.

Preferably, said air channel comprising a first end in fluid communication with the atmosphere and a second end in fluid communication with the internal cavity of said container; said trigger mechanism comprising a receptacle for receiving a plug for removably engaging with said first end of said air channel. More preferably, when said trigger mechanism being in the first trigger position, said plug abutting against said first end of said air channel to close thereof; and when said trigger mechanism being in the second trigger position, said plug being away from said first end of said air channel to open thereof.

Advantageously, said channel is operationally opened before said lid assembly assuming said second configuration.

In one embodiment, when said switch being at said first position and said trigger mechanism being at said second trigger position, said spout being maintained at said first spout position; and when said switch being at said second position and said trigger mechanism being at said second trigger position, said spout being at said second spout position.

In one embodiment, the top surface of said lower lid is provided with a fifth protrusion for assisting said switch maintained in its second position, whereby allowing said third interaction means aligned with said fourth interaction means.

In one embodiment, said lid assembly is provided with a first locking means on said switch, and a second locking means on said trigger mechanism, wherein: when said switch assuming its first position, said first locking means interacting with said second locking means, thereby the movement of said trigger mechanism being limited; when said switch assuming its second position, said first locking means not interacting with said second locking means, thereby said trigger mechanism is movable between said first trigger position and said second trigger position.

In one embodiment, said first lid is provided with a stopper for facilitating the sliding of the leg of said trigger mechanism.

In one embodiment, at least one of said vertical wall members of said second lid is provided with a sixth protrusion for facilitating the sliding of the leg of said trigger mechanism.

In one embodiment, said switch comprising a plate, wherein: when said switch being in its said first position, said plate being adjacent or adjacent to the end of one of the legs of said trigger mechanism, thereby limiting the movement of said trigger mechanism; and when said switch being in its said second position, said plate being away from the end of one of the legs of said trigger mechanism, thereby allowing the movement of said trigger mechanism.

In one embodiment, said trigger mechanism is provided with a bridge member connecting with the pairs of legs of said trigger mechanism, wherein said bridge member having a notch provided thereon; at least one of the legs of said trigger mechanism is provided with a recessed portion on the side facing said switch; said switch comprising a first protrusion and a second protrusion, wherein: when said switch assuming its first position, said first protrusion and said second protrusion of said switch engaging with said bridge member and said recessed portion, respectively, thereby limiting the movement of said trigger mechanism; when said switch assuming its second position, said first protrusion and said second protrusion of said switch disengaging with said bridge member and said recessed portion, respectively; and the position of said first protrusion of said switch being aligned with the position of said notch of said bridge member, thereby when said trigger mechanism moving from said first trigger position to said second trigger position, said first protrusion of said switch being received by said notch.

DESCRIPTION OF THE DRAWINGS

Some embodiments of the present invention will now be explained, with reference to the accompanied drawings, in which:—

DETAILED DESCRIPTION OF PREFERRED EMBODIMENTS OF THE INVENTION

Figure 1A:
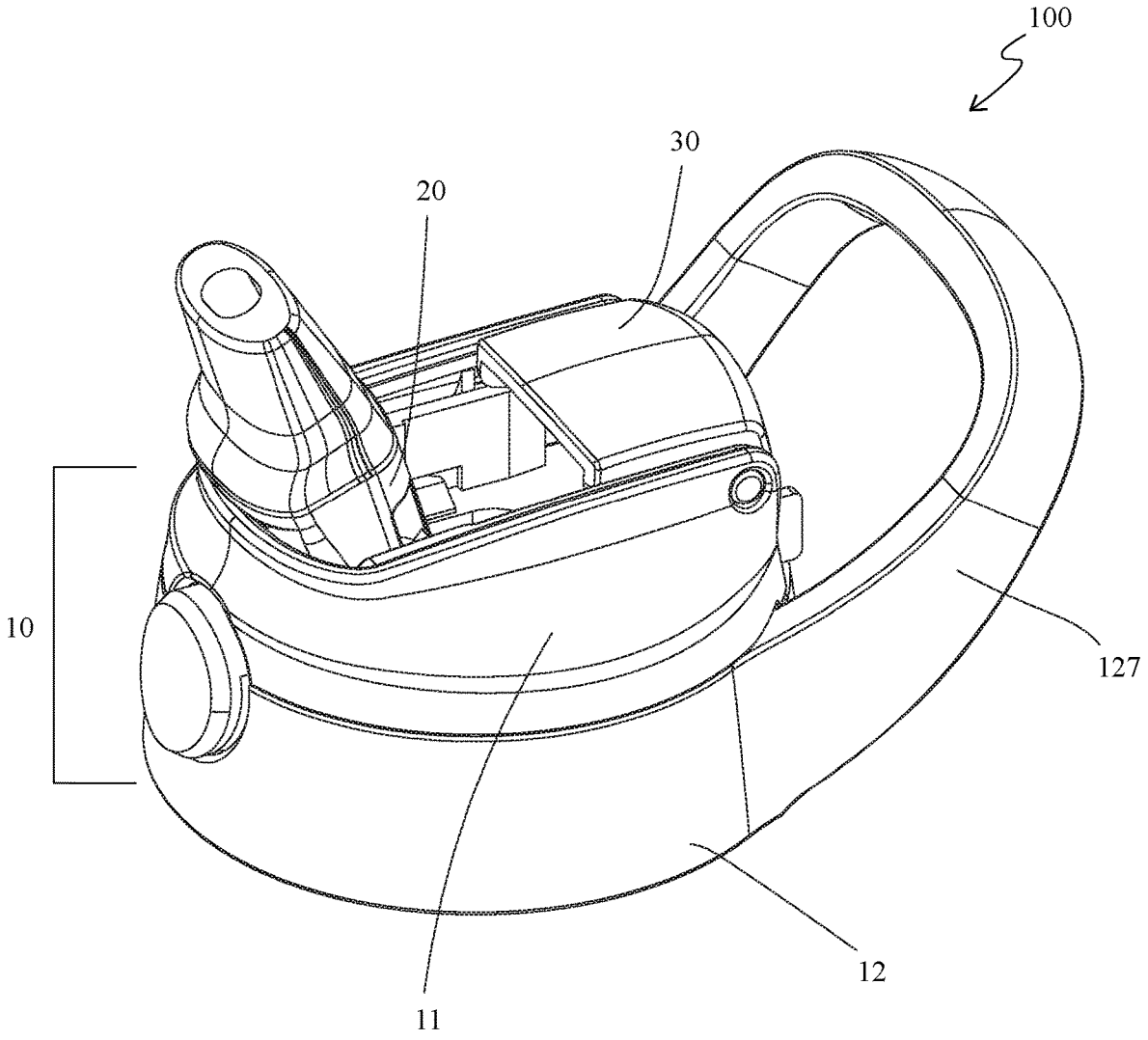
FIG. 1A a perspective view of a lid assembly of a first embodiment of the present invention showing a spout in a dispensing position.

The present invention is now presented by way of examples with reference to the figures in the following paragraphs. Objects, features, and aspects of the present disclosure are disclosed in or are apparent from the following description. It shall be understood by one of ordinary skilled in the art that the following description is a description of exemplary embodiments only, and is not intended as limiting the broader aspects of the present disclosure, which broader aspects are embodied in the exemplary constructions.

It should be noted that, unless otherwise defined, the technical terms or scientific terms used in the embodiments of the present invention shall have the usual meanings understood by person with ordinary skills in the art to which the present invention belongs. "First", "second" and similar expression used in the embodiments of the present invention do not indicate any order, quantity or importance, but are only used to distinguish different components. "Front", "rear", "left", "right", "upper", and "lower" and other terms indicating orientation or similar terms are only described for the exemplary relative positional relationship shown in the drawings to facilitate the understanding. It does not limit the disclosed components in the present invention can only follow this specific relative positional relationship. "Connect or the like", "mount or the like" or "secure or the like" or "assemble or the like" is not limited to physical or mechanical connections, whether direct or indirect.

Referring now to the drawings, FIGS. 1 to 7F illustrate a container lid assembly 100 is a first embodiment of the present invention.

FIG. 1A is a perspective view of the lid assembly 100 having a spout 20 configured in a dispensing position.

Figure 1B:
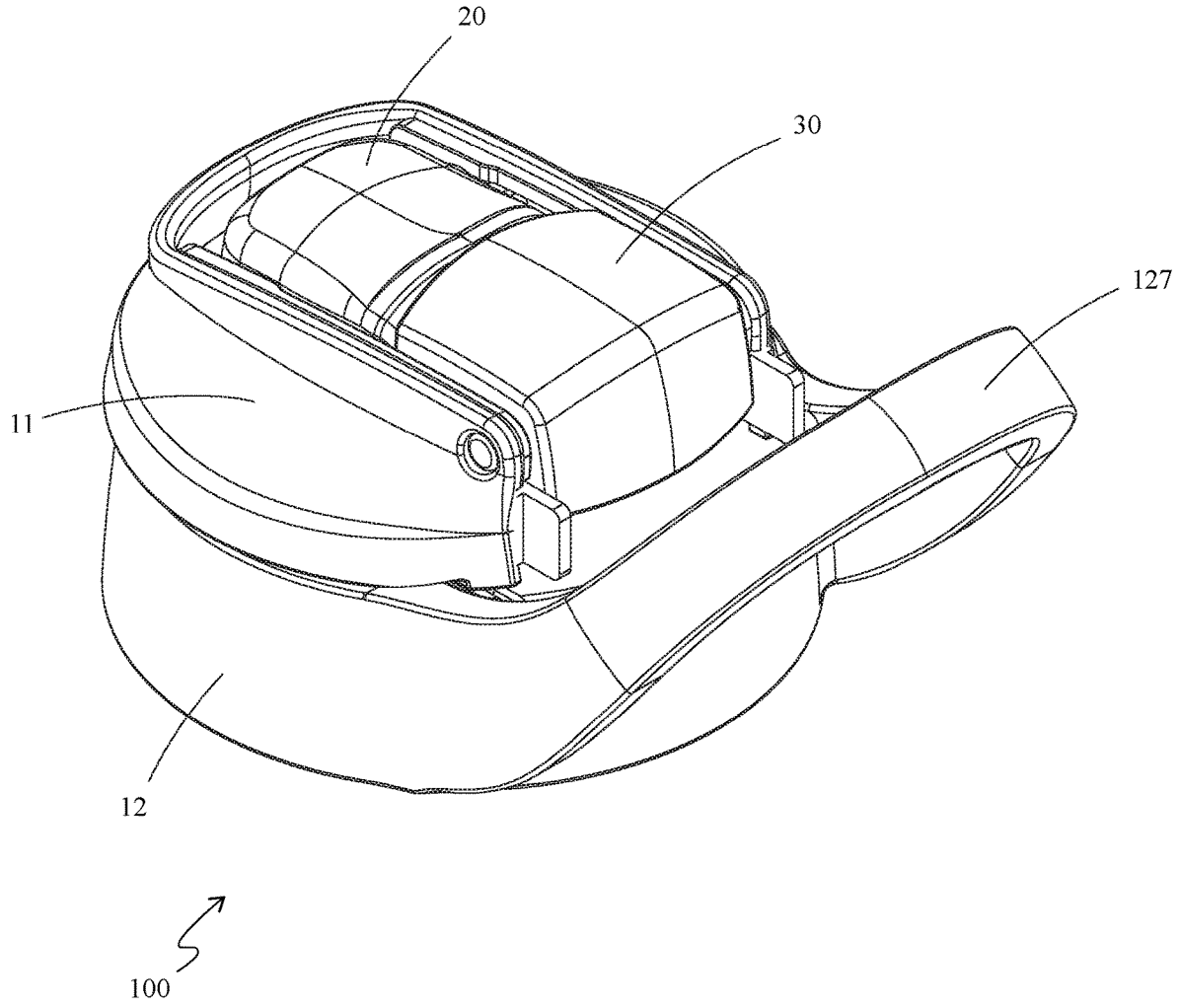
FIG. 1B a perspective view of the lid assembly of the first embodiment, showing the spout in a stowed position.

FIG. 1B is a perspective view of the lid assembly 100 having the spout 20 configured in a stowed position.

Unless otherwise defined herein, the dispensing/stowed position of the spout 20 described herein shall be understood as the dispensing/stowed configuration of the spout 20, and vice versa. In this context, "dispensing configuration of the spout" means that the spout 20 is in fluid communication with the container where the lid assembly 100 is assembled; and "stowed configuration of the spout" means that the spout 20 is not in fluid communication with the container where the lid assembly 100 is assembled.

Figure 2A:
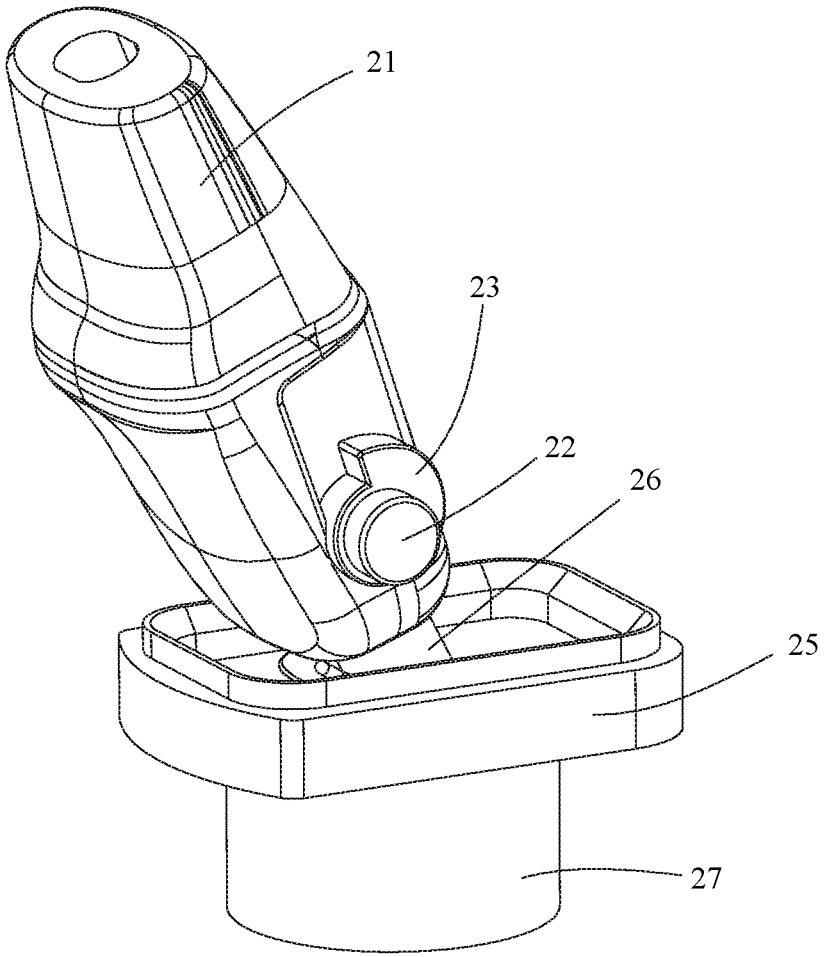
FIG. 2A a perspective view of a spout connected to a connector of the lid assembly of the first embodiment.
Figure 2B:
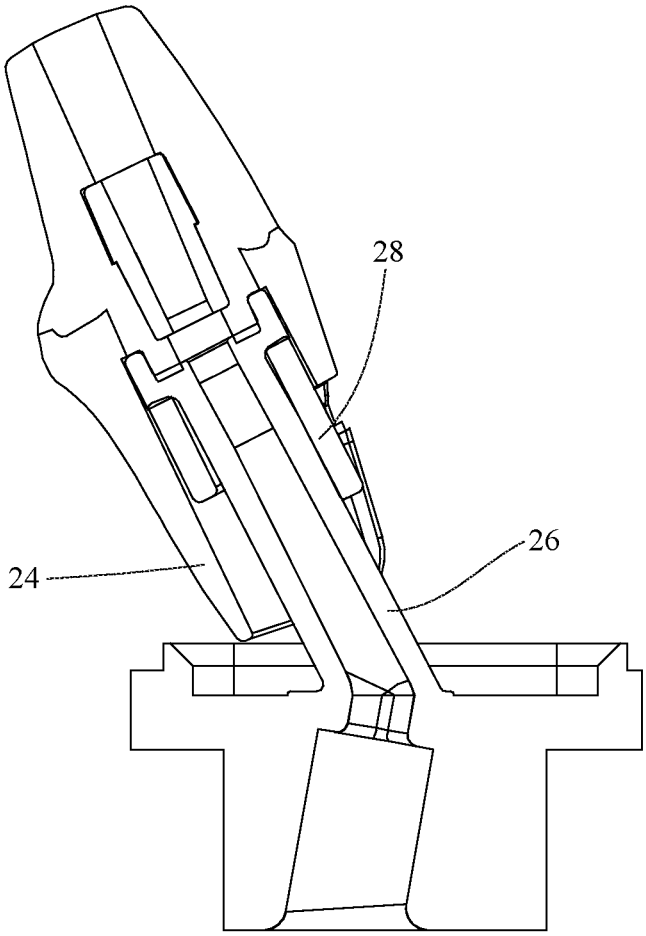
FIG. 2B a cross-section view of the illustration in FIG. 2A.

FIGS. 2A-2B illustrate that the spout 20 includes an upper portion in a form of the mouthpiece 21 and a lower portion. On the lateral side of the lower portion of the spout 20 is provided with a pair of opposite axles 22 on which a cam face 23 is provided thereon. In some embodiments, the circumference of the axles can be designed to provide the cam face. In some embodiments, the shape of the axles can be designed to provide the cam face. The cam face 23 in figures is an illustrative example of an engagement means provided to the spout of the present invention only. It shall be understood that the engagement means may be embodied as a notch or a cutout instead.

FIGS. 2A-2B shows that the spout 20 is connected to a connector 25, with a seal ring 28. The connector 25 has a connecting tube 26 extending into the cavity of the lower portion of the spout 20 defined by surrounding edge 24 of the spout 20, and a lower portion 27.

The lower portion 27 is selectively provided with a drinking tube or straw that is in fluid communication with the beverage contained in the container, defining a passageway between the mouthpiece 21 and the beverage in the container, allowing a user to drink the beverage with the mouthpiece 21. For brevity's sake, the drinking tube or straw is not shown in figures.

In practical application, preferably, the connecting tube 26 and/or the connector 25 is made of resilient material such as silicone, polytetrafluoroethylene (PTFE), polyethylene (PE), so that the connecting tube 26 can be bent or folded under pressure and can be restored to its original condition or shape after the pressure away. In other words, the connecting tube 26 is configured to adapt a first shape under biasing and a second shape when said biasing removed. In some embodiments, the connecting tube 26 is bent or folded to block the forementioned passageway and allowing the spout 20 in the stowed position/configuration. When the pressure on the connecting tube 26 is released, the spout 20 changes to the dispensing position/configuration due to the inherent physical property of the connecting tube 26.

With the foregoing description, one shall be understood that the spout 20 with the connecting tube 26 can be configured to obtain a dispensing configuration or a stowed configuration due to the inherent physical property of the connecting tube 26.

The lid assembly 100 is adapted for removable placement on an open top of the container. The container is used to contain or store beverage and may be of any type known in the art.

Figure 3:
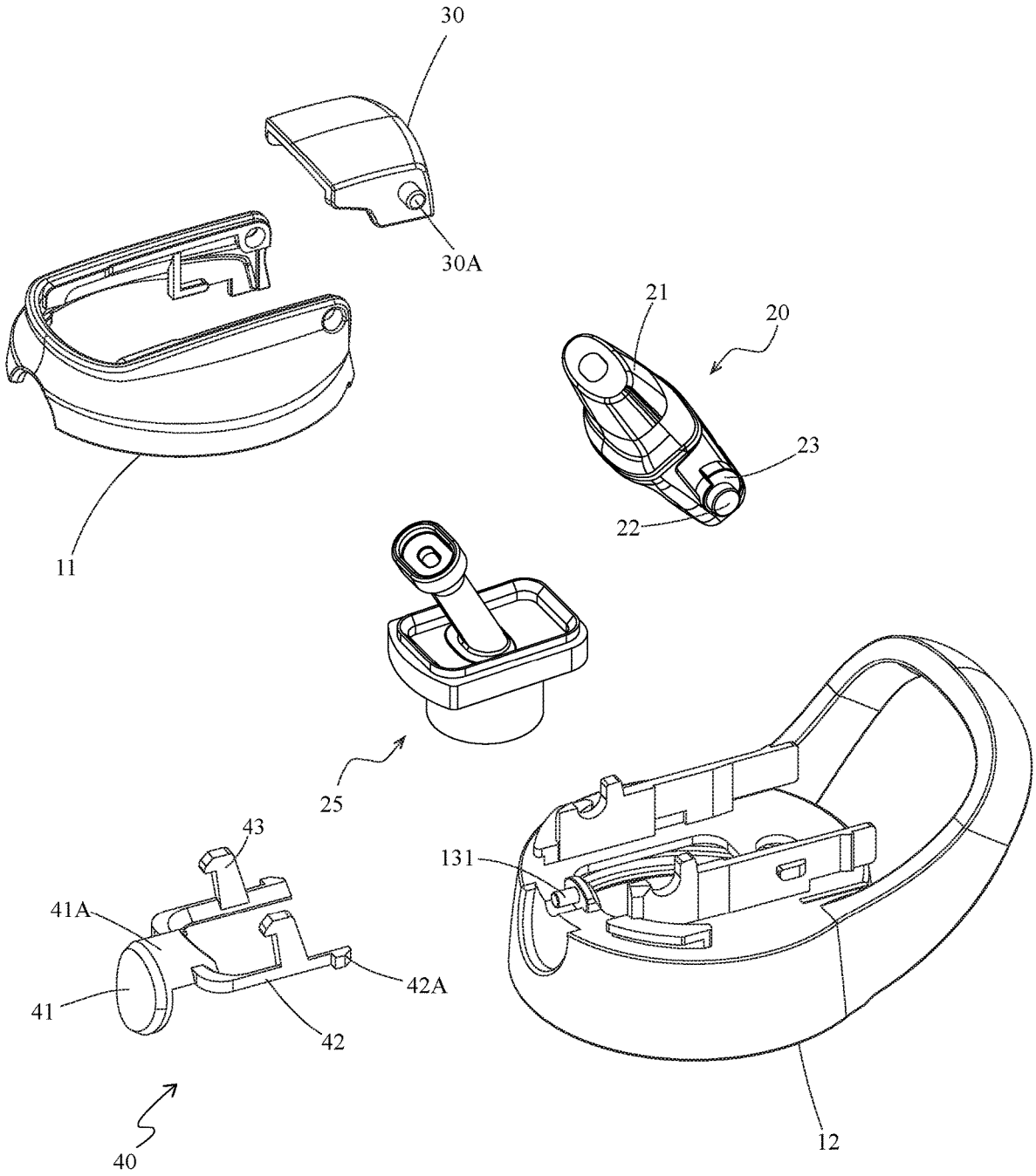
FIG. 3 a perspective exploded view of the lid assembly of the first embodiment.

FIG. 3 illustrates that the lid assembly 100 comprises a lid member 10, a spout 20 pivotably mounted to the lid member 10, and a cover 30.

The lid member 10 is formed by assembling an upper lid 11 with a lower lid 12. The lower lid 12 is provided with a handle 127 to ease of holding the lid assembly and also the container when the lid assembly assembled thereto. The lower lid 12 is adapted to be removably attached to the open top of the container (not shown in figures). For example, the lower lid 12 has internal threads formed on an inner surface thereof, which cooperate with the external threads formed on an outer surface of the top wall of the container to secure the lid assembly to the container.

FIG. 3 also illustrates a trigger mechanism 40, which is configured to operate the pivoting movement of the spout 20, whereby enabling the spout 20 is positioned between the stowed and dispensing configurations with respect to the lid member 10.

The trigger mechanism 40 comprises a first portion and a second portion joining with the first portion. The first portion includes a button 41 and a neck 41A. The second portion includes a pair of legs 42 in bifurcation extending away from the first portion. The legs 42 each has a protrusion 42A at the end of the leg 42 opposite the button 41, and an actuator cam face 43 projecting upwards from the leg 42. The actuator cam face 43 is an illustrative example of an engagement means provided to the trigger mechanism of the present invention. The engagement means on the trigger mechanism 40 is able to engage with the engagement means on the spout 20 for controlling the pivoting movement of the spout. The actuator cam face in figures is an illustrative example only, and shall not be construed as limitation to the present invention.

Figure 4A:
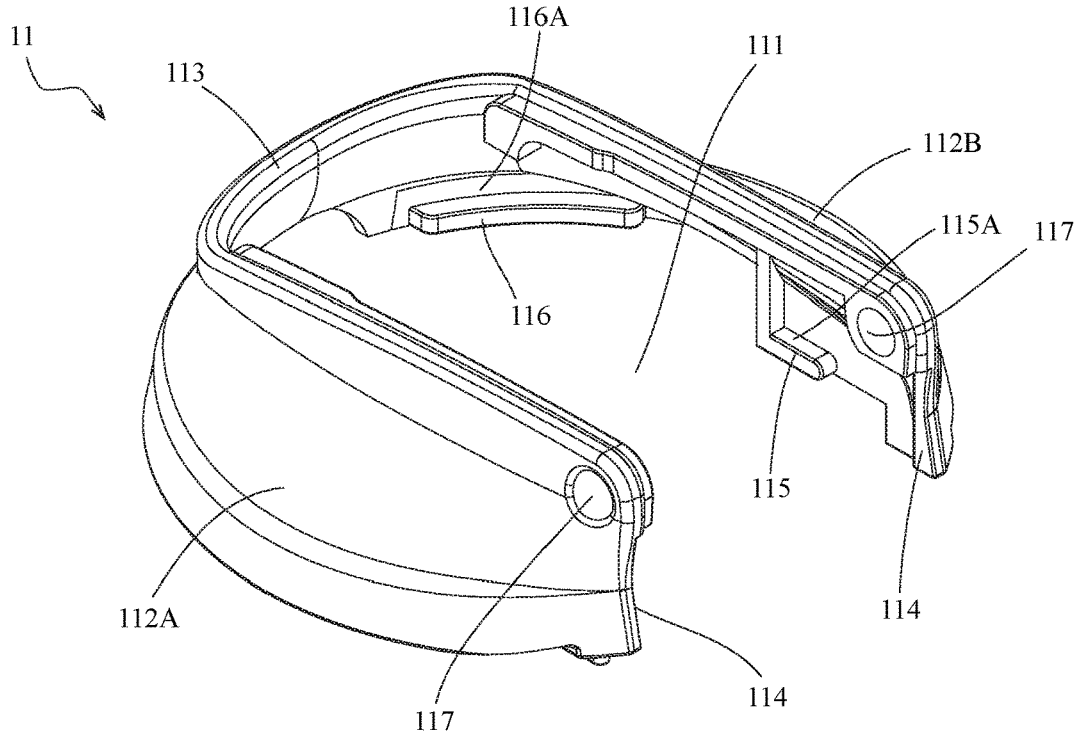
FIG. 4A a perspective elevation view of an upper lid of the first embodiment.
Figure 4B:
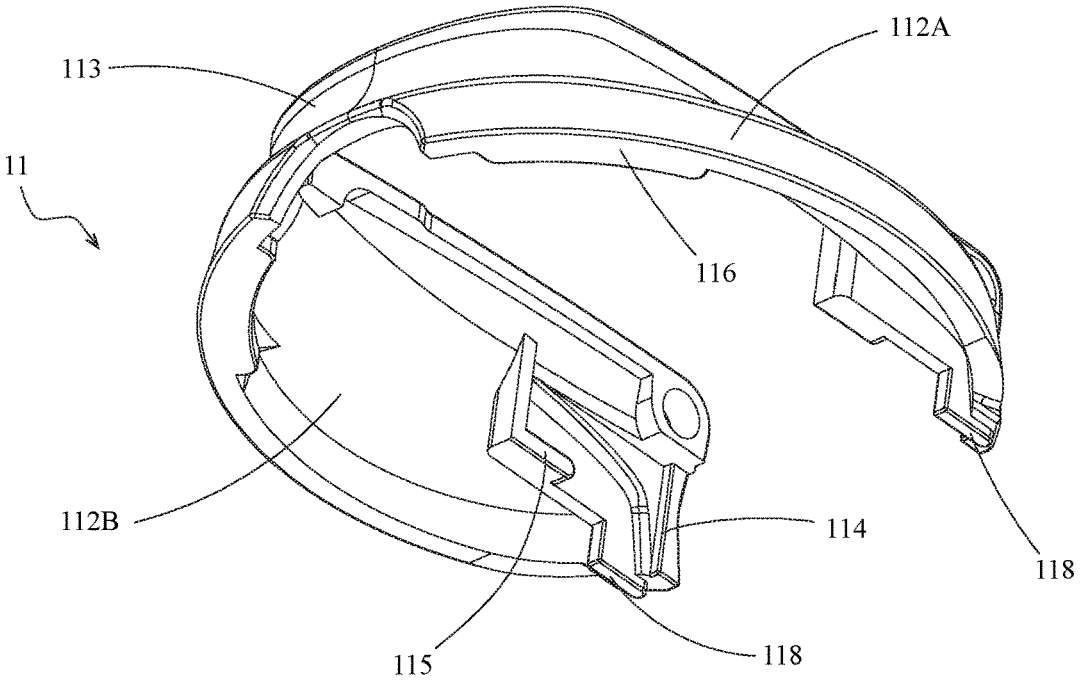
FIG. 4B a perspective bottom view of the upper lid of the first embodiment.

FIGS. 4A and 4B show the upper lid 11 in details. The upper lid 11 resembles a letter "U" and has a top opening 111 used to accommodate the spout 20 in place when it is fully stowed (see FIG. 1B). The upper lid 11 comprises two opposite circumferential walls 112A and 112B. The walls 112A and 112B are connected by a front wall 113 and each comprises a free end opposite said front wall 113. Each of the walls 112A, 112B is profiled to provide a first protrusion 115, a second protrusion 116, a third protrusion 114, and a leg 118.

Taking wall 112A as an example, contexts below are examples used to describe the first protrusion 115, the second protrusion 116, the third protrusion 114, and the leg 118. One shall be understood that the first protrusion 115, the second protrusion 116, the third protrusion 114, and the leg 118 on wall 112B may be the same or may be substantially the same as those components on wall 112A.

The inner surface of the wall 112A is provided with the first protrusion 115 configured as a L-shaped protrusion or a L-shaped projection. The dimension and configuration of the first protrusion 115 together with the inner surface of the wall define an aperture 115A.

The inner surface of the wall 112A of is provided with the second protrusion 116 extending along a portion of the perimeter of the inner surface of the wall 112A, preferably at a position adjacent or adjacent to the front wall 113. The second protrusion 116 in figures is configured as a step however which is for illustrative purpose only. The dimension and configuration of the second protrusion 116 together with the inner surface of the wall 112A define an aperture 116A.

At the free end of the wall 112A, the upper portion thereof is formed a hole 117, through which the cover 30 is pivotably mounted on the upper lid 11 with its axles 30A (as shown in FIG. 3).

The third protrusion 114 is provided adjacent or adjacent to the free end of the wall 112A, 112B and is adjacent or adjacent to the hole 117, and is adapted in a form of a latch or a step configured to extends across the height of the wall 112A.

The leg 118 is adapted in a form of protrusion extending from the bottom side of the upper lid 11. The leg 118 is provided adjacent or adjacent to the free end of the wall 112A, 112B in FIG. 4B.

Figure 5:
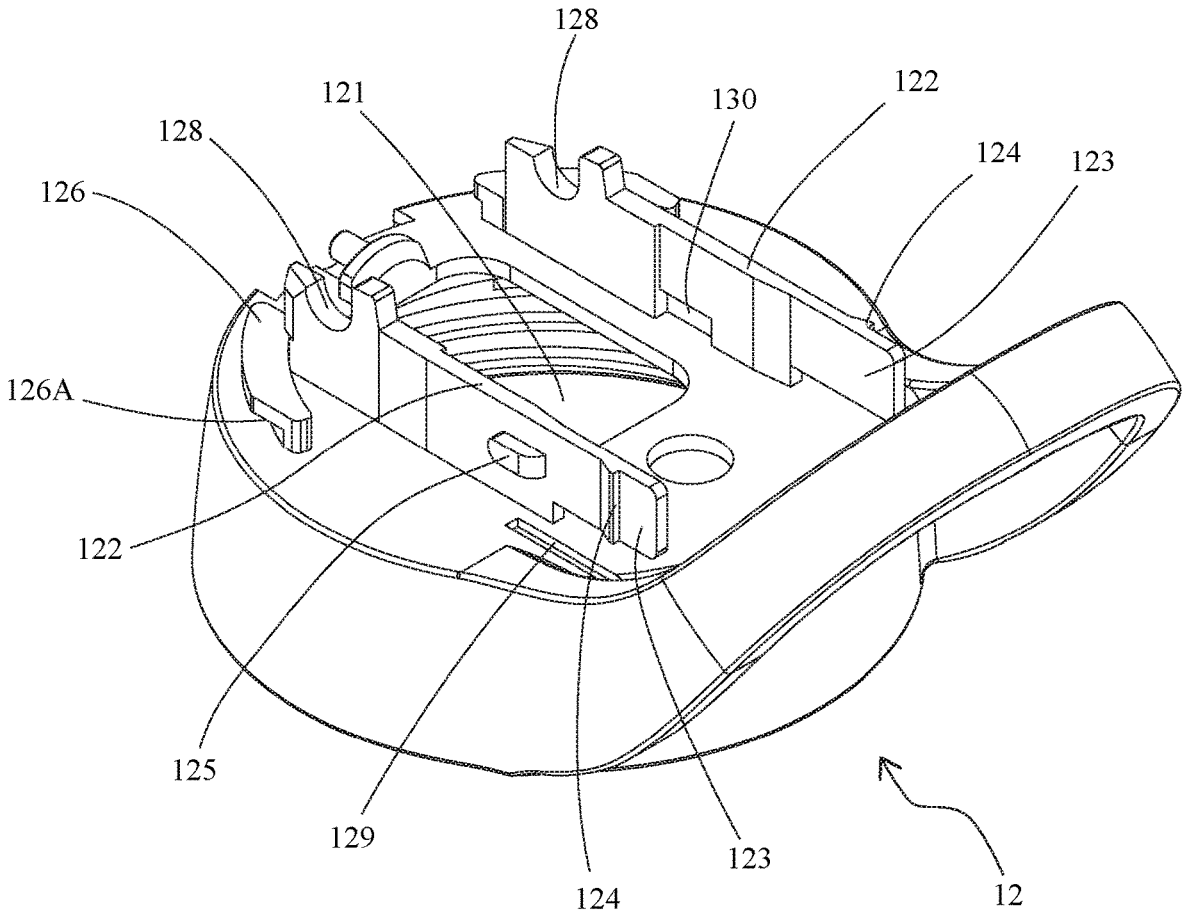
FIG. 5 a perspective view of a lower lid of the first embodiment.

FIG. 5 shows the lower lid 12. It comprises a through hole 121, two wall members 122 standing from the top surface of the lower lid 12 and arranged in a symmetric manner on two sides of the through hole 121. The through hole 121 is sized and shaped fit to accommodate the connector 25.

The wall members 122 has a first end provided with a notch 128 and a second end provided with a manipulation end 123. The notch 128 faces upwards, allowing the axles 22 of the spout 20 sitting thereon. The wall member further comprises a first protrusion 124 and a second protrusion 125.

Example of the first protrusion 124 in FIG. 5 is in a form of ramp extending outwardly from an outer surface of the wall member 122 in the vicinity of the manipulation end 123. The first protrusion 124 has one slope facing the protrusion 125 and one vertical wall facing the manipulation end 123. The manipulation end 123 is made resilient. Therefore, when the manipulation ends 123 are being compressed in a direction towards each other, the first protrusions 124 move closer to each other.

Example of the second protrusion 125 in FIG. 5 is provided on each of the wall members 122 and is outwardly exposed. The second protrusions 125 are dimensioned and positioned to correspond to the aperture 115A of the upper lid 11, such that the second protrusion 125 is configured to slide in the aperture 115A, it enables a secured connection between the upper lid 11 and the lower lid 12. It also enables sliding movement of the protrusion 125 in the aperture 115A.

The lower lid 12 is provided with a third protrusion 126, for example, extending along a part of the perimeter of the lower lid 12, preferably on the top surface of the lower lid 12. As shown in FIG. 5, the third protrusion 126 adjoins the first end of the wall member 122. The third protrusion 126 in figures is configured as a step however which is for illustrative purpose only. The dimension and configuration of the third protrusion 126 together with the surface of the lower lid 12 define an aperture 126A used to receive the second protrusion 116 of the upper lid 11. In this respect, it shall be understood that the third protrusion 126 is received in the aperture 116A of the upper lid 11. By collaboration between the second protrusion 116 and the third protrusion 126, and the apertures 116A and 126A, it enables a slidable connection between the upper lid 11 and the lower lid 12. It enables sliding movement between the upper and lower lids.

The top surface of the lower lid 12 is provided with a pair of grooves 129 adjacent or adjacent to the manipulation end 123.

Figure 6A:
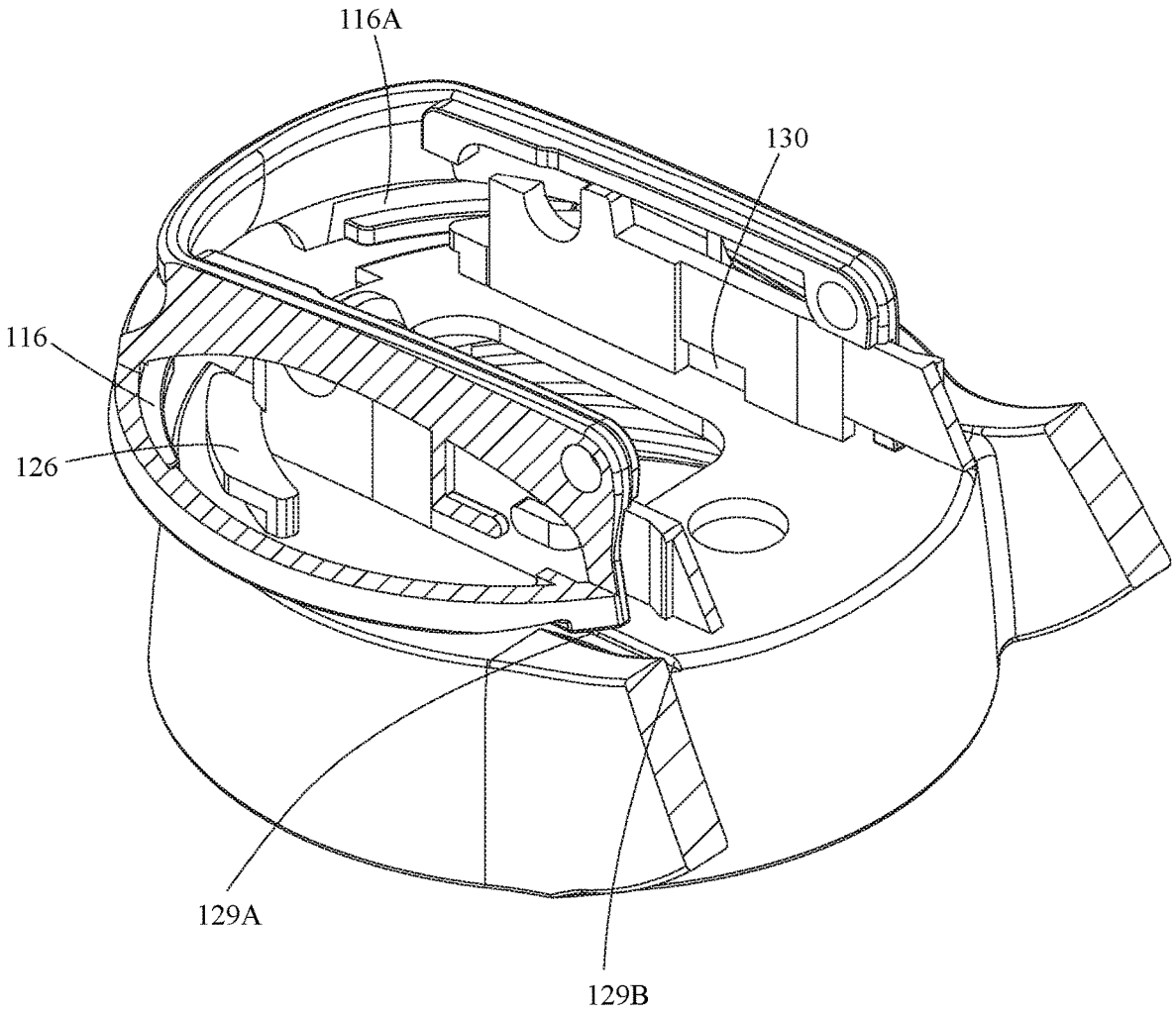
FIG. 6A a perspective view of the lid assembly of the first embodiment in partial cross-section, in which the upper lid is not secured to the lower lid yet.
Figure 6B:
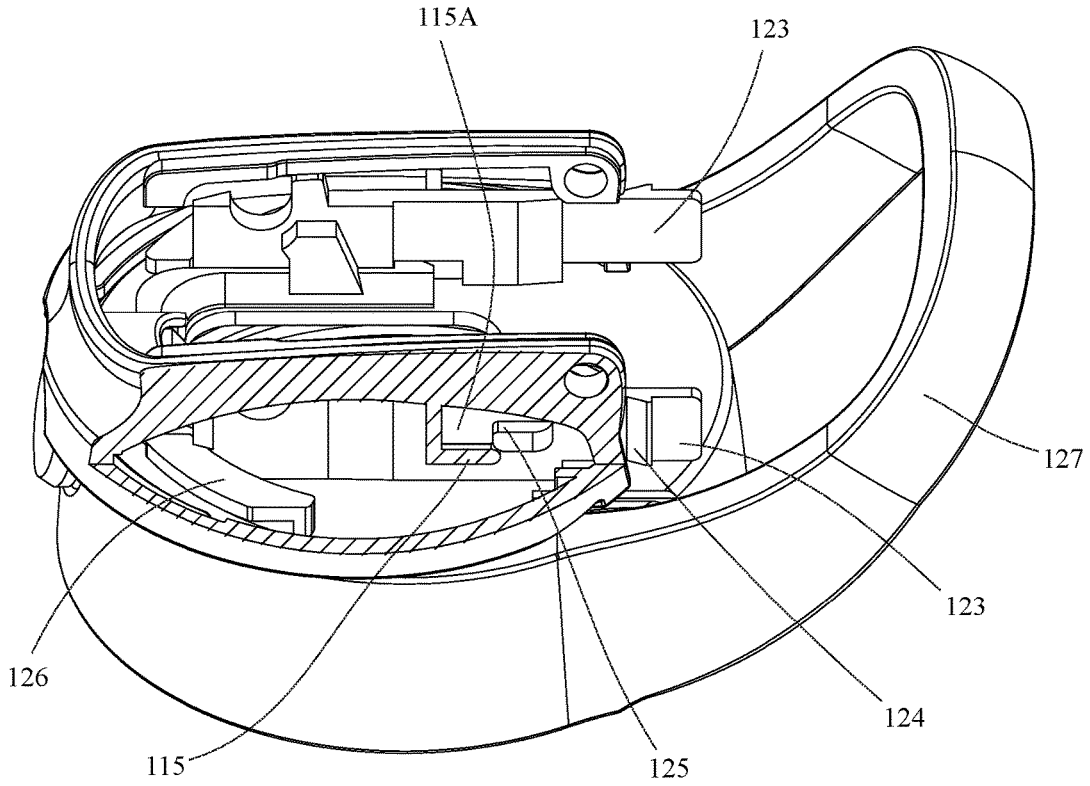
FIG. 6B a perspective view of the lid assembly of the first embodiment in partial cross-section, in which the upper lid is not secured to the lower lid yet.

Context below describes the assembling of the upper lid 11 to the lower lid 12. The upper lid 11 is first positioned over the lower lid 12 in which the legs 118 of the upper lid 11 sit in the grooves 129 of the lower lid 12, in particular the first end 129A of the groove 129, as shown in FIG. 6A. It can be seen that in FIG. 6A, the second protrusion 116 and the third protrusion 126 are slightly away from each other. The illustration in FIG. 6B corresponds to the illustration in FIG. 6A. FIG. 6B illustrates that at the condition where the upper lid 11 is not yet securely assembled to the lower lid 12, the second protrusion 125 is not yet received by the aperture 115A. FIG. 6B further illustrates that the first protrusion 124 is upstream of the third protrusion 114 in the sliding direction in the assembling depicted in FIGS. 6A-6B. In other words, the first protrusion 124 is ahead of the third protrusion 114 in the sliding direction in the assembling depicted in FIGS. 6A-6B.

Sliding the assembly in FIGS. 6A and 6B further, the third protrusion 126 is received in the aperture 116A; the legs 118 of the upper lid 11 sit in the second end 129B of the groove 129; and the second protrusion 125 is received by the aperture 115A. In particular, it can be seen in FIG. 6C that the third protrusion 114 is slid over the first protrusion 124, and thus the upper lid 11 is securely assembled to the lower lid 12 preventing the upper lid 11 to slide backwards.

Figure 6C:
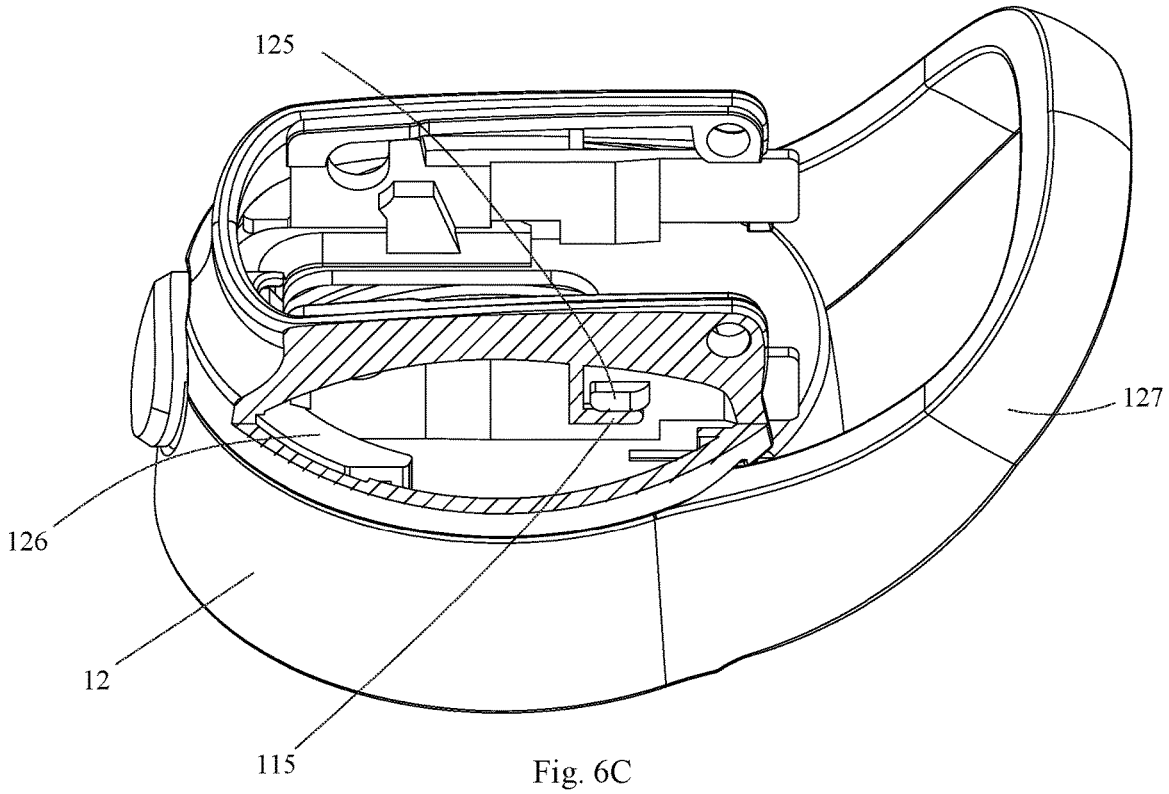
FIG. 6C a perspective view of the lid assembly of the first embodiment in partial cross-section, in which the upper lid is secured to the lower lid.

It shall be envisaged that when disassembling the assembly in FIG. 6C, it can be done by first pressing the pair of manipulation ends 123 towards each other, then sliding the upper lid 11 backwards by sliding the legs 118 from the second end 129B towards the first end 129A, whereby the third protrusion 114 displaces backwards into a position where the third protrusion 114 is on the slope side of the first protrusion 124.

With the foregoing described design of the upper lid 11 and the lower lid 12, the assembling and disassembling between the upper lid 11 and the lower lid 12 are easy and free of screws.

Figure 6D:
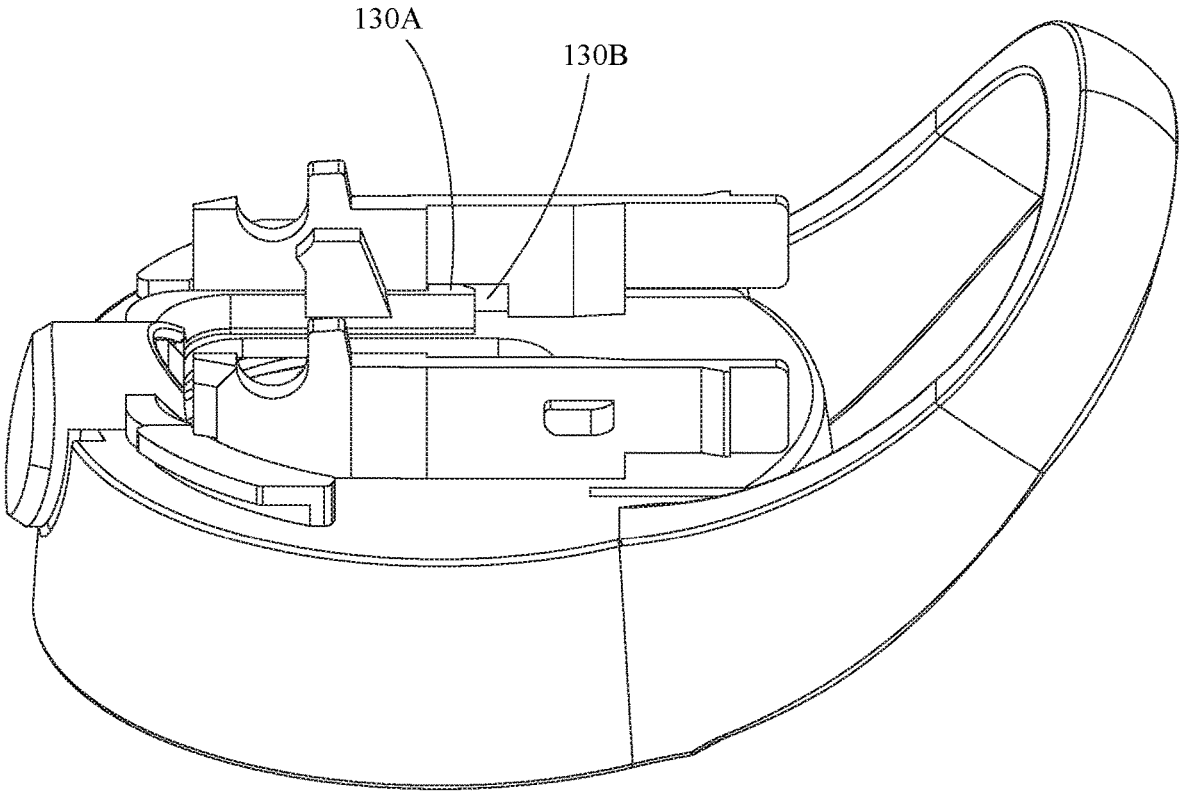
FIG. 6D a perspective view of the lid assembly of the first embodiment in partial cross-section, in which a trigger mechanism is secured to the lower lid.

FIG. 6D illustrates the assembling of the trigger mechanism 40 to the lower lid 12. For brevity's sake, the trigger mechanism 40 comprises a spring between a fourth protrusion 131 of the lower lid 12 and the button 41 but is not shown in figures. With reference to FIGS. 5 and 6D, it shall be understood that the assembling of the trigger mechanism 40 to the lower lid 12 is obtained by placing the trigger mechanism 40 over the lower lid 12, in which the protrusion 42A of the leg 42 is slidably received in the respective passage 130 of wall member 122 of the lower lid 12. The pair of passages 130 are disposed on the inner side of the wall member 122, as shown in FIGS. 5, 6A, and 6D. The passage 130 is defined as a groove in these figures. However, it shall be understood that the passage 130 can also be an aperture. With the aid of the spring, the trigger mechanism 40 can be configured to move between a first trigger position where the protrusion 42A of the leg 42 is at the first end 130A of the passage 130 and a second trigger position where the protrusion 42A of the leg 42 is at the second end 130B of the passage 130. For illustration, it shall be understood that when a user presses the button 41 with his/her finger, the spring is compressed and thus the trigger mechanism 40 moves from the first trigger position to the second trigger position. When the user's finger is away, the spring is relaxed and thus the trigger mechanism 40 moves from the second trigger position to the first trigger position.

Figure 7A:
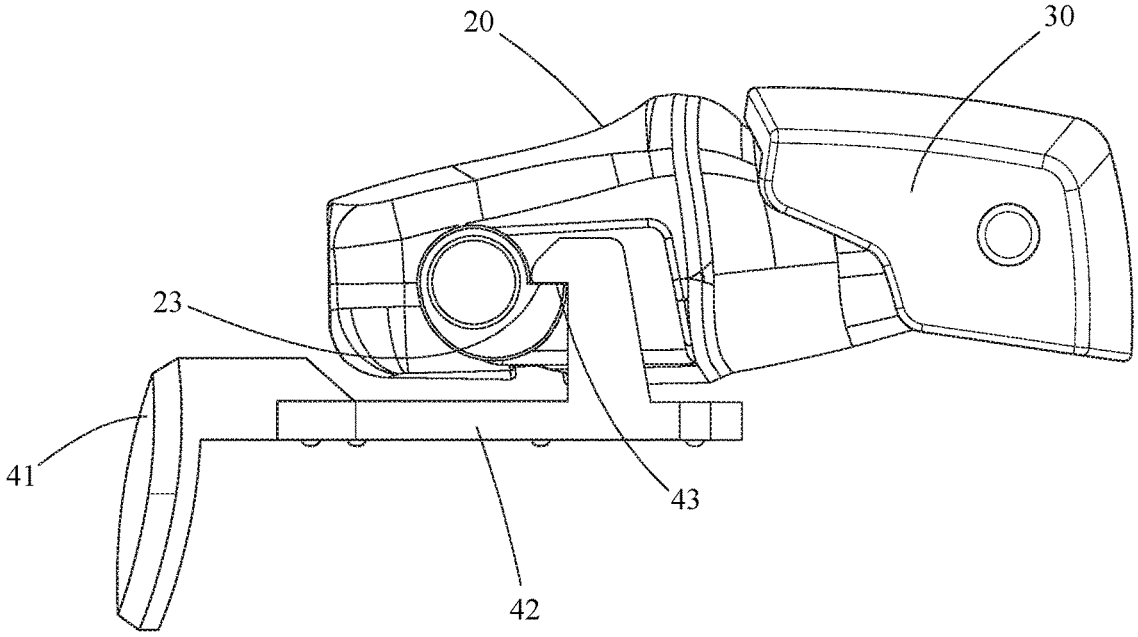
FIG. 7A is a perspective view of the spout unit of the first embodiment in a stowed configuration.
Figure 7B:
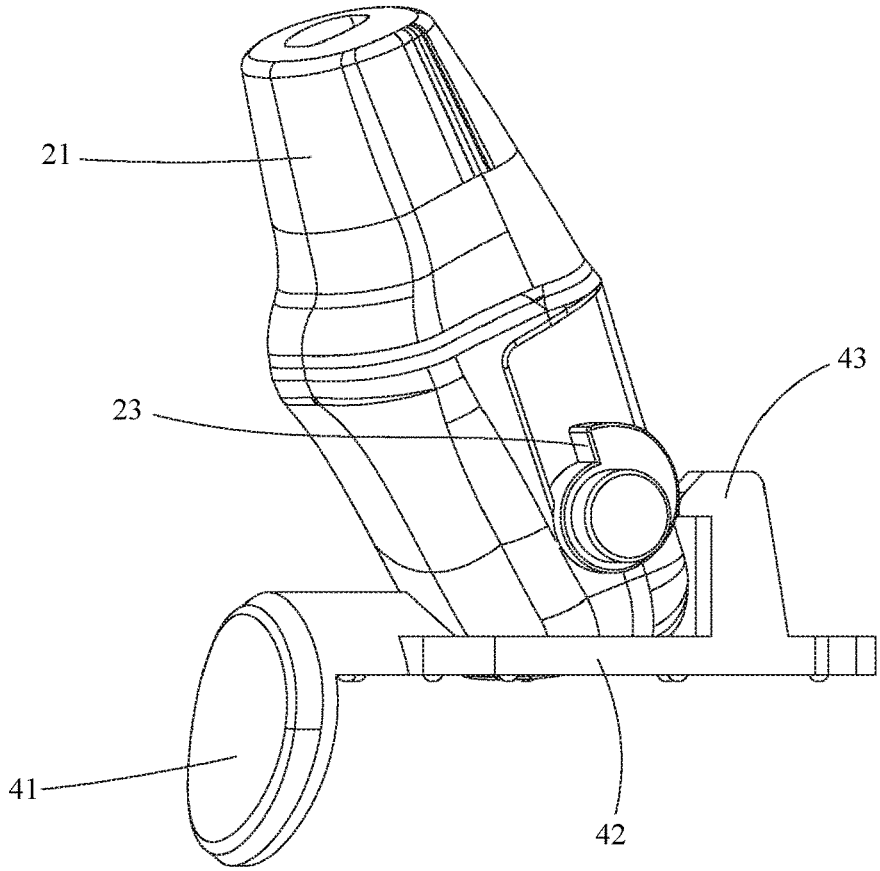
FIG. 7B is a perspective view of the spout unit of the first embodiment in dispensing configuration.

FIGS. 7A and 7B illustrate how the trigger mechanism 40 engages with the spout 20 so as to limit the pivoting movement of the spout 20. For brevity's sake, the assembly in FIGS. 7A and 7B do not show the connector 25. With the foregoing description, those skilled in the art would understand how the spout 20 performs the pivoting movement.

It can be seen that, the actuator cam face 43 of the leg 42 is engageable with the cam face 23 of the spout 20. In particular, FIG. 7A relates to the spout 20 is in the stowed configuration, in which the actuator cam face 43 is engaged with the cam face 23 of the spout 20 so as to prevent the spout 20 from pivoting upwards. FIG. 7B relates to the spout 20 is in the dispensing configuration, in which the actuator cam face 43 is disengaged with the spout cam face 23.

One of the essential features of the present invention is that the design and configuration of the spout 20 and the trigger mechanism 40 provides interaction between the spout 20 and the trigger mechanism 40 during the lid assembly of the present invention is in operation. For example, the edge 24 at the lower portion of the spout 20 (as shown in FIG. 2B) is an example of an interaction means on the spout of the present invention, the neck 41A provided to the first portion of the trigger mechanism 40 (as shown in FIG. 3) is an example of an interaction means on the trigger mechanism of the present invention. FIGS. 7C-F are schematic drawings illustrating how these interaction means work together to control the pivoting movement of the spout 20 from the stowed configuration in FIG. 7C to the dispensing configuration in FIG. 7F.

Figure 7C:
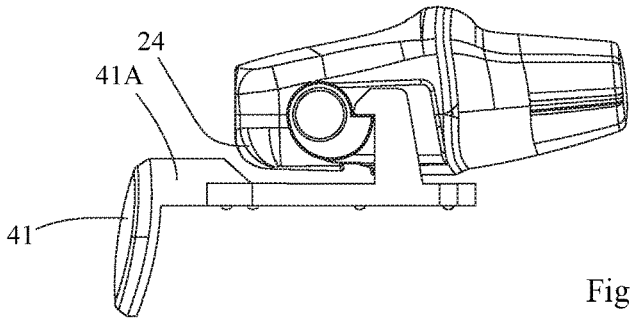
FIGS. 7C-F schematic drawings illustrating the pivoting of the spout from stowed configuration to dispensing configuration.

FIG. 7C illustrates that the trigger mechanism 40 is positioned at the second trigger position where the protrusion 42A of the leg 42 is at the second end 130B of the passage 130. The actuator cam face 43 of the leg 42 engages with the cam face 23 of the spout 20, the spout 20 is maintained in a substantially horizontal position with respect to the lid member 10.

Figure 7D:
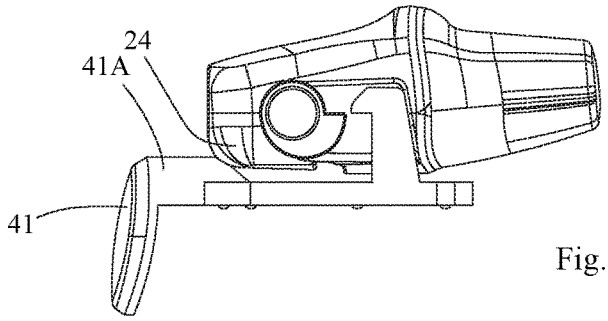
Figure 7E:
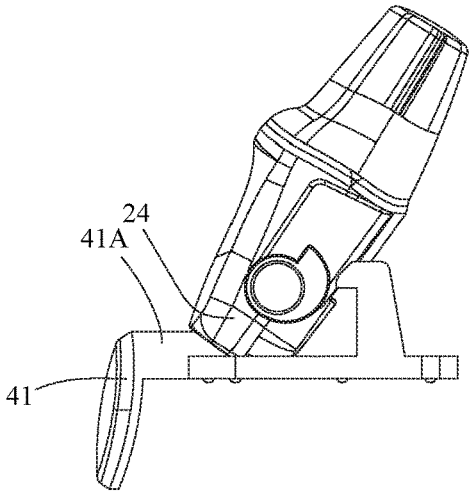

FIGS. 7D-7E illustrates the condition of the spout 20 and the trigger mechanism 40 when the button 41 is remained pressed. When a user presses the button 41, the trigger mechanism 40 moves in a direction towards the handle 127, the actuator cam face 43 of the leg 42 disengages with the cam face 23 of the spout 20, and thus the axles 22 of the spout 20 begins to rotate about the notch 128, the spout 20 pivotably moving upwards and then being maintained at an inclined angle due to the interaction between the interaction means, preferably an acute angle with the lid member 10. Said inclined angle is defined by the intersection between the longitudinal axis of the spout 20 and the longitudinal axis of the trigger mechanism 40 in a direction towards the handle 127. More preferably, the acute angle ranges from 30° to 60°.

In FIG. 7E, the spout 20 is in a slanted position with respect to the lid member 10 or a slanted configuration, in which the neck 41A of the button 41 is partially received in the cavity defined by the edge 24 of the spout 20. With foregoing description, it shall be understood that the pivoting movement of the spout 20, in FIGS. 7D-7E, is hindered by the neck 41A and thus the spout 20 is maintained at the preferable acute angle.

Figure 7F:
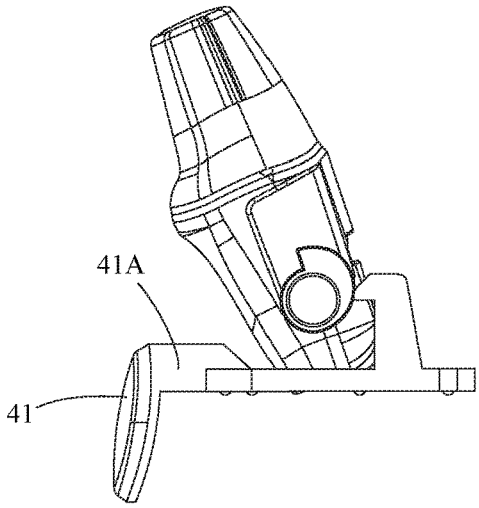

FIG. 7F illustrates the condition of the spout 20 and the trigger mechanism 40 when the button 41 is relaxed, i.e., the trigger mechanism 40 resumes to its original position or moves back into the first position where the protrusion 42A of the leg 42 is at the first end 130A of the passage 130. Since the hindrance by the neck 41A to the edge 24 of the spout is removed, the spout 20 then continues the pivoting movement about the notch 128 due to the inherent physical property of the connecting tube 26.

The spout 20 in FIG. 7F is maintained at an angle≥90°, preferably an obtuse angle, with the lid member 10. Said obtuse angle is defined by the intersection between the longitudinal axis of the spout 20 and the longitudinal axis of the trigger mechanism 40 in a direction towards the handle 127.

In FIG. 7F, the spout 20 is in the dispensing position with respect to the lid member 10 or the dispensing configuration.

The operation described in FIGS. 7C-7F provides an advantage that the opening of the spout 20 is a controlled process. The spout 20 in the slanted configuration or the slanted position allows the pressure inside the container can be first released preferably in a direction away from the user. It helps preventing the user to get burnt by hot gas or water ejected out when the spout 20 is opened rapidly.

It shall be understood that the description on the interaction means on the spout and the trigger mechanism is an example to demonstrate how the pivoting movement of the spout is hindered so as to maintain the spout at a slanted position due to the interaction means on the spout and the trigger mechanism due to the geometry, shape, position, or dimension of the interaction means on the spout and the trigger mechanism.

Figure 8A:
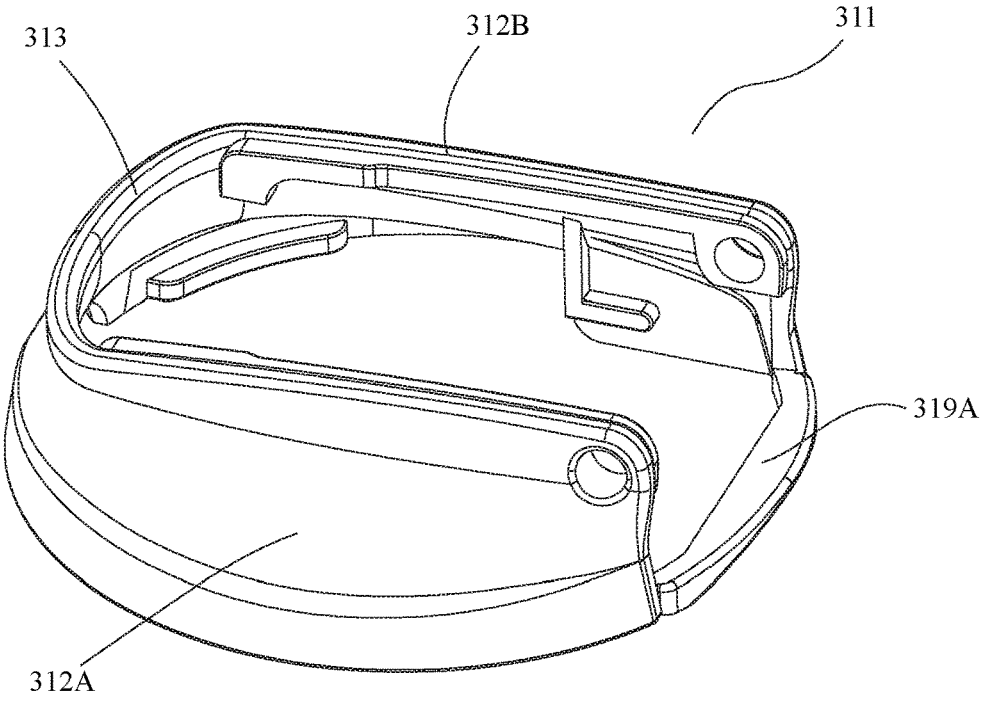
FIG. 8A is a perspective elevation view of an upper lid of a second embodiment of the present invention.
Figure 8B:
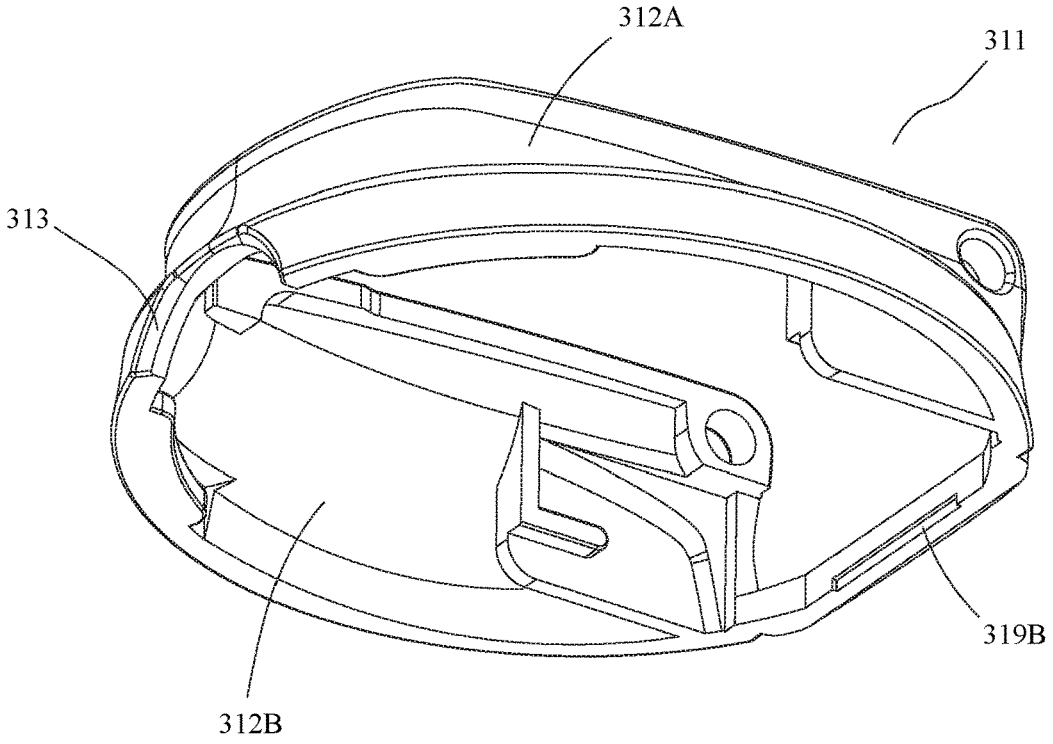
FIG. 8B is a perspective bottom view of the upper lid of the second embodiment.

FIGS. 8A-8B illustrate an upper lid 311, a second embodiment of the present invention. For brevity's sake, only the differences between the upper lid of the first embodiment and the upper lid of the second embodiment are explained in details.

The upper lid 311 comprises two opposite walls 312A, 312B connected by a front wall 313 and a connecting member for example a bridge 319A. The length of the bridge 319A is substantially the same as the distance between the walls 312A and 312B. FIG. 8B illustrates that the bridge 319A is provided with a recess in a form of slit 319B. The slit 319B is sized fit to receive a first protrusion 324 in a form of latch provided on the top surface of a lower lid 312 as illustrated in FIG. 9, which shows that the first protrusion 324 is adjacent or adjacent to the perimeter of the lower lid 312.

Figure 9:
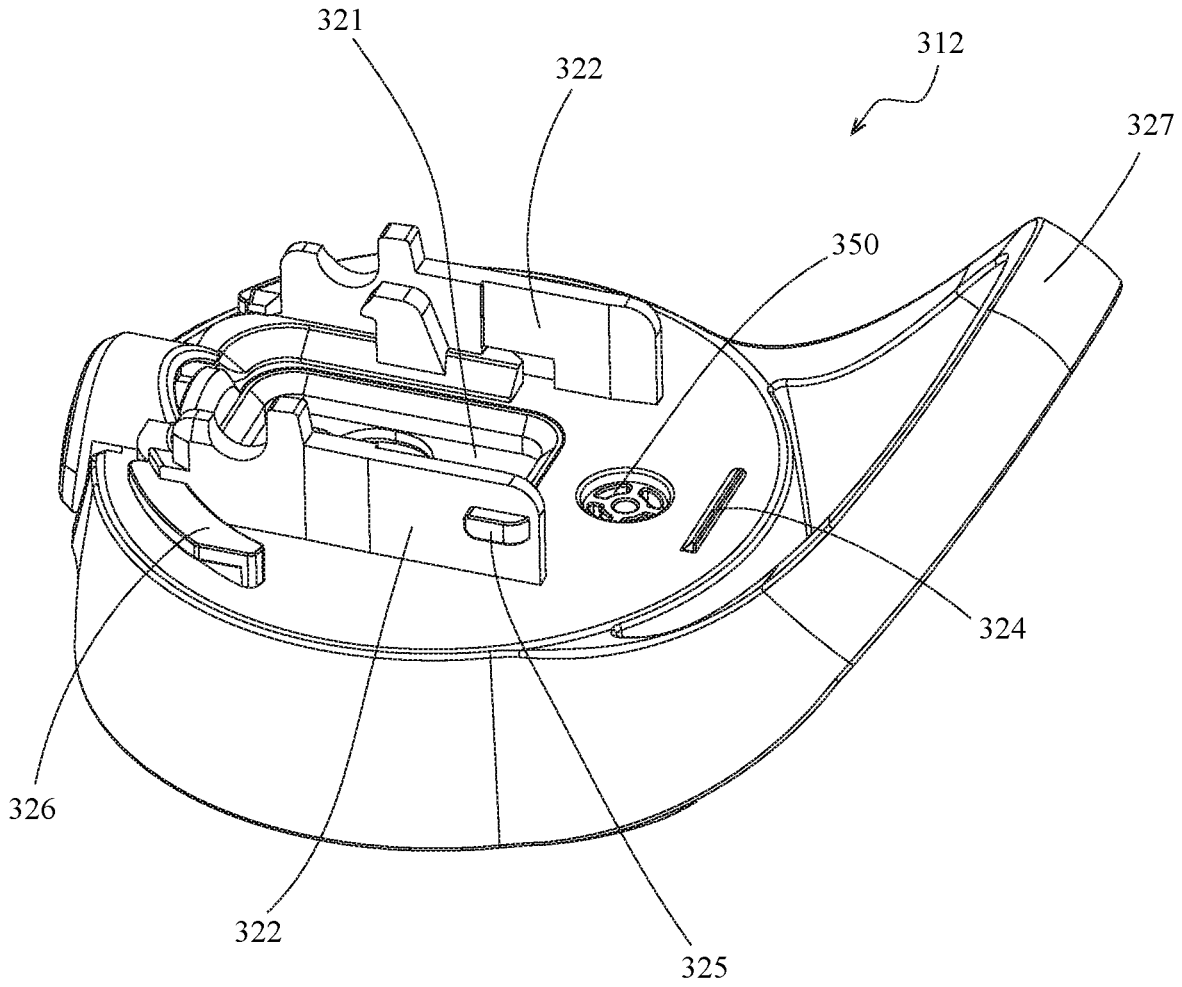
FIG. 9 is a perspective view of a lower lid of the second embodiment.

The lower lid 312 in FIG. 9 is a second embodiment of the lower lid of the present invention. The lower lid 312 comprises a through hole 321, two wall members 322 vertically arranged in a symmetric manner on two sides of the through hole 321. The lower lid 312 is provided with a second protrusion 325 outwardly extending from the wall member 322, and a third protrusion 326.

It shall be understood that the interaction between the slit 319B and the first protrusion 324 aid the assembling between the upper lid 311 and the lower lid 312, and aid positioning the upper lid 311 and the lower lid 312. When the slit 319B sits on the first protrusion 324 (or the first protrusion 324 fittingly inserts into the slit 319B), the sliding between the upper lid 311 and the lower lid 312 is limited, thereby the upper lid 311 and the lower lid 312 are assembled. When the upper lid 311 and the lower lid 312 are assembled, gentle pulling the bridge 319A in an upward direction (e.g., upwardly substantially along the longitudinal axis of the beverage container) causes the upper lid 311 slightly tilted with respect to the lower lid 312. In doing so, the first protrusion 324 is disengaged from/with the slit 319B, and ultimately is entirely separated from the slit 319B. At this moment, sliding force to the upper lid 311 or the lower lid 312 causes slidable movement of the upper lid 311 in a horizontal direction relative to the lower lid 312 until the upper lid 311 is removed from the lower lid 312. The disassembling between the upper lid and the lower lid allows the cover, the spout, and the trigger mechanism can be disassembled with ease for cleaning thoroughly.

Figure 10:
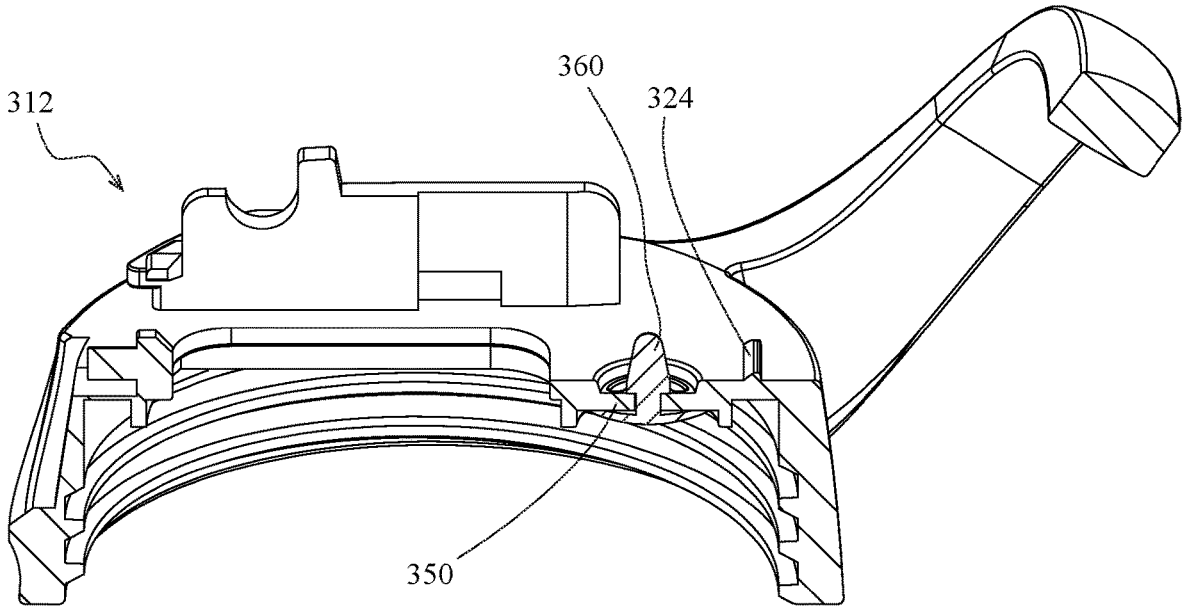
FIG. 10 is a perspective view, in cross-section, showing a valve is provided to the lower lid of the second embodiment.
Figure 11:
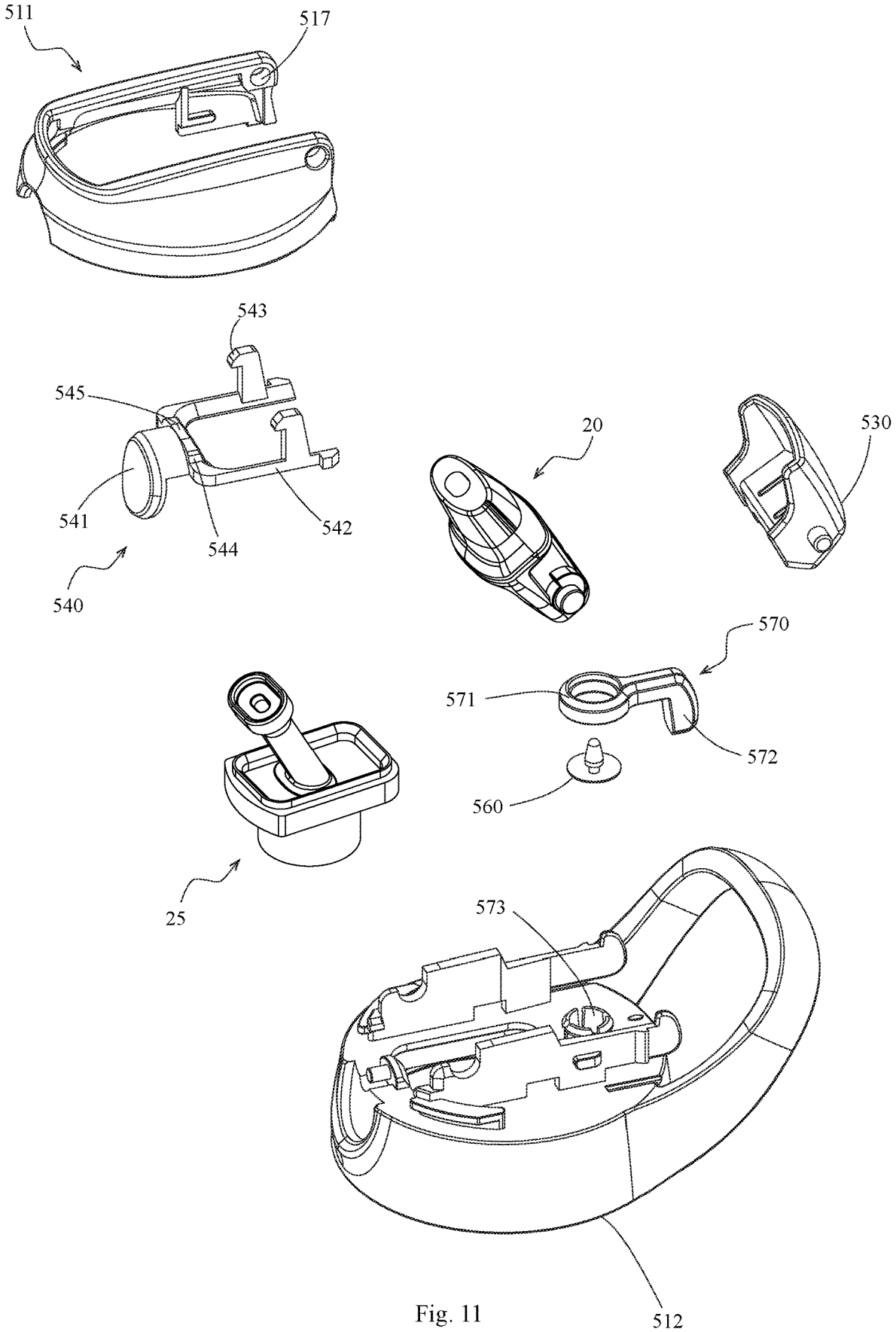
FIG. 11 is a perspective exploded view of a lid assembly of a third embodiment of the present invention.

FIG. 9 illustrates that the lower lid 312 is provided with a vent 350 in the vicinity of the periphery adjacent or adjacent to the handle 327. A valve 360, which allows gas outflow from the inside of the container to the external environment, is positioned and dimensioned such that it is snugly insertable into the vent 350 from underside of the vent 350, as illustrated in FIG. 10. The valve 360 is umbrella valve or duckbill valve, for example.

FIGS. 11-16 illustrate a container lid assembly, a third embodiment of the present invention. For brevity's sake, only the differences between the previous embodiments and the third embodiment are explained in details. Specifically, the lid assembly of this third embodiment comprises a switch 570, and a bushing 573 provided on the top surface of the lower lid 512 to surround the vent 550.

Figure 12:
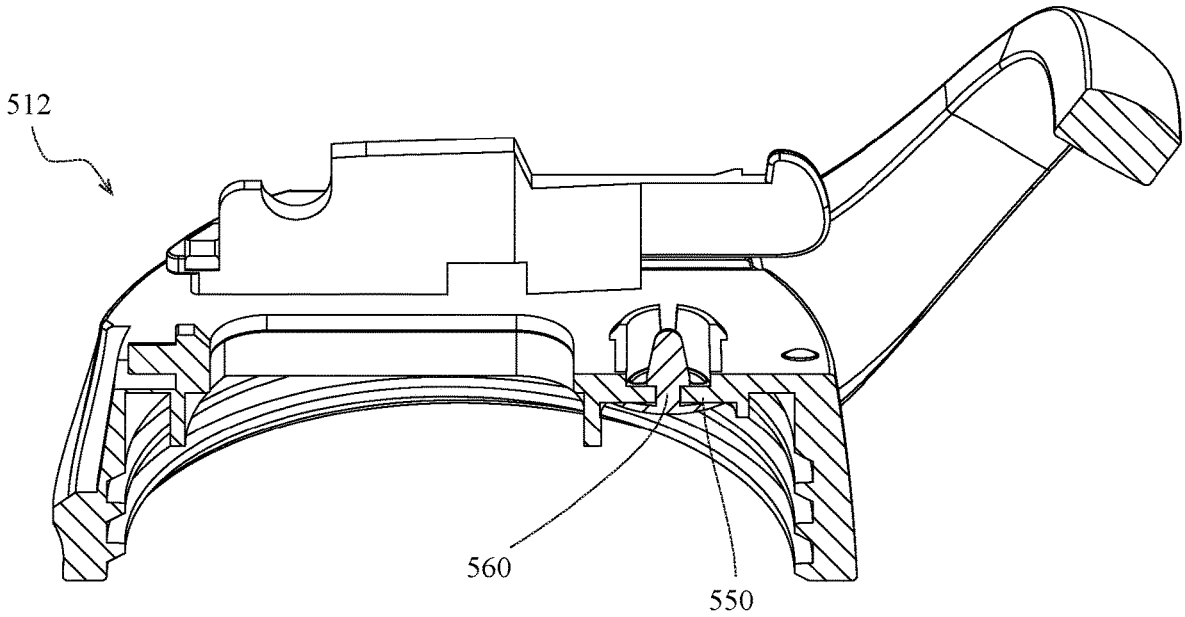
FIG. 12 is a perspective view, in cross-section, showing a valve is provided to the lower lid of the third embodiment.
Figure 13A:
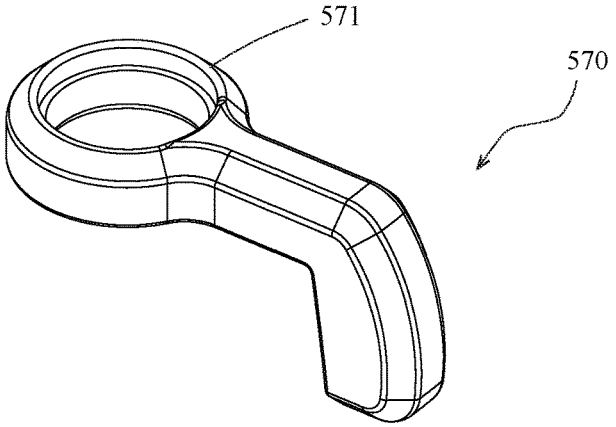
FIGS. 13A-D illustrates a switch of the lid assembly of the third embodiment with different views.
Figure 13B:
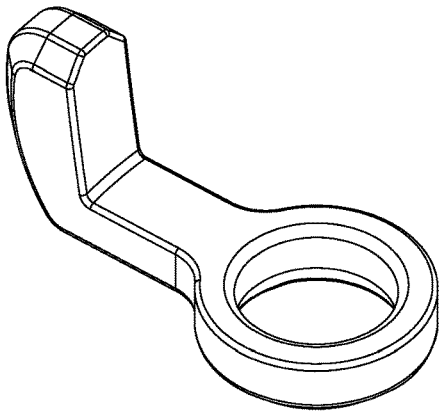
Figure 13C:
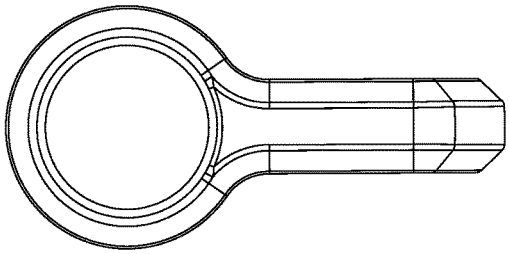
Figure 13D:
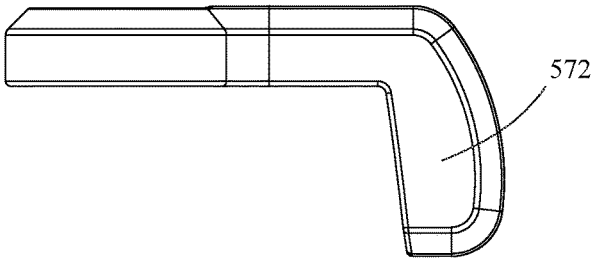

FIG. 12 illustrates a valve 560 is snugly inserted into a vent 550 from underside of the vent 550.

FIGS. 13A-D illustrates the switch 570 in different views. The switch 570 is provided with a ring-shaped head 571 allowing the switch 570 snugly sleeving on the bushing 573, and an arm portion 572. In this embodiment, the arm portion 572 is an example of an interaction means of the present invention to control the pivoting movement of the spout.

The assembly between the switch 570 and the bushing 573 allows the arm portion 572 to rotate about the bushing 573 between a first position where the arm portion 572 is misaligned with a cutout 532 (the cutout 532 is at the lower portion of the cover 530 along a central longitudinal axis of the cover 530), and a second position where the arm portion 572 is aligned with the cutout 532. In this embodiment, the cutout 532 is an example of an interaction means of the present invention, which works together with the interaction means of the switch 570 to control the pivoting movement of the spout.

Figure 14A:
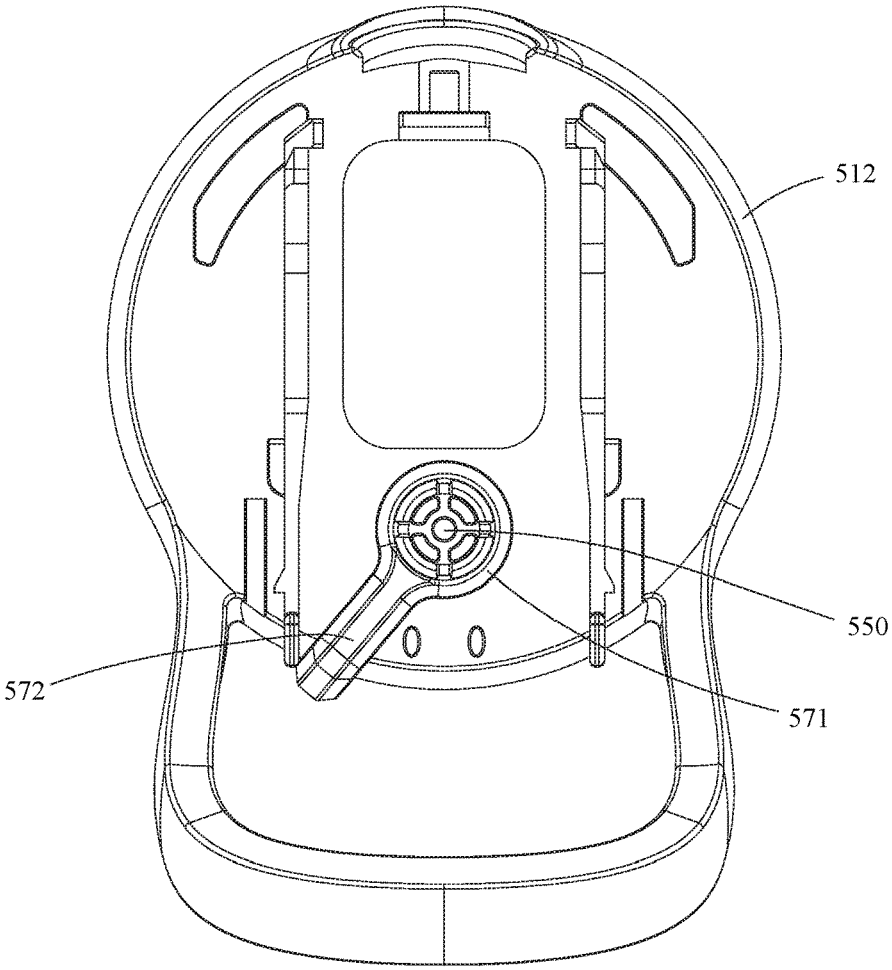
FIG. 14A is an elevation view illustrating the third embodiment, in which an arm portion of the switch is in a first position.
Figure 14B:
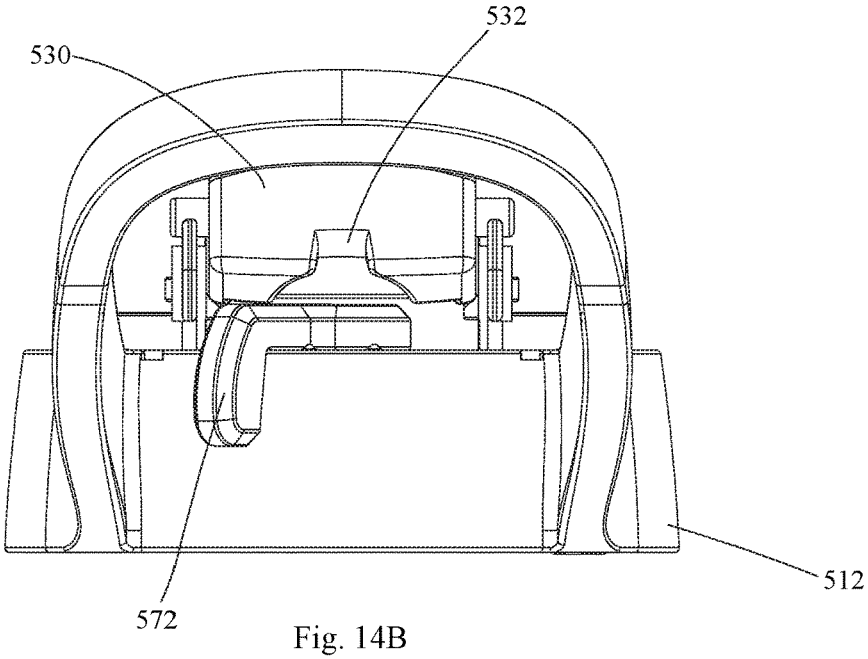
FIG. 14B is a side view illustrating the third embodiment, in which a cover is closed and the arm portion is in the first position.

FIGS. 14A-B illustrate the arm portion 572 is configured to stop at its first position, where the arm portion 572 is misaligned with the cutout 532, i.e., the interaction means of the cover does not interact with the interaction means of the switch 570. It shall be understood that, when the cover 530 undergoes a pivoting movement about holes 517, such movement is hindered by the arm portion 572, as illustrated in FIG. 14B.

Figure 15A:
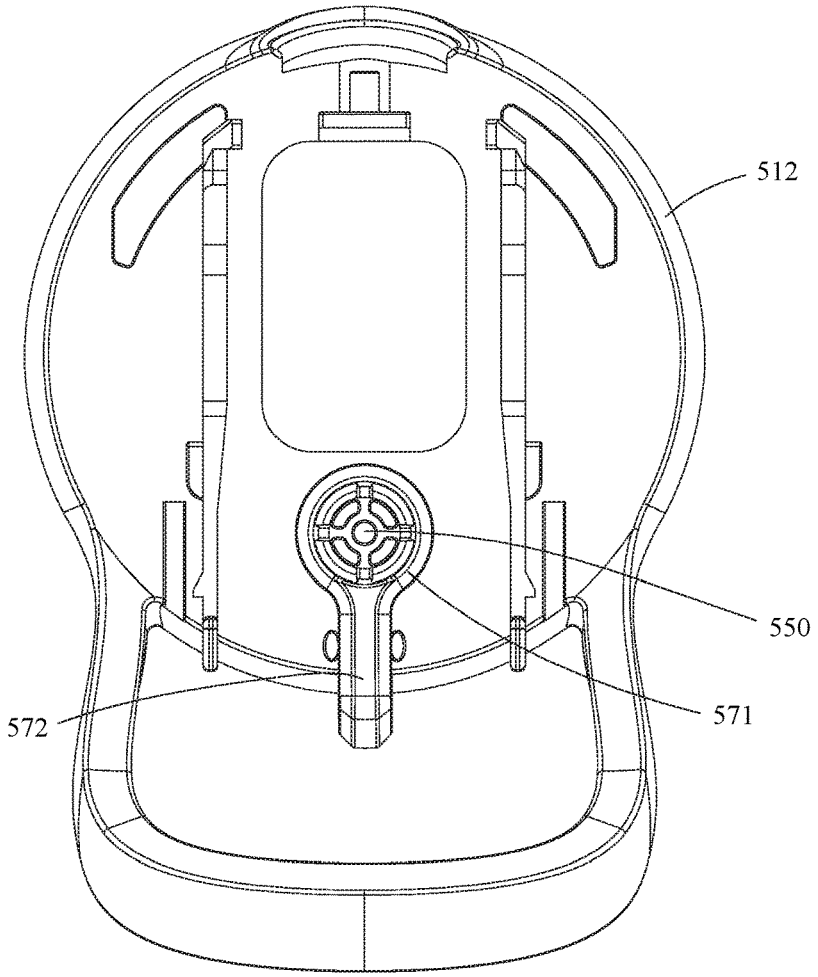
FIG. 15A is an elevation view illustrating the third embodiment, in which the arm portion is in a second position.
Figure 15B:
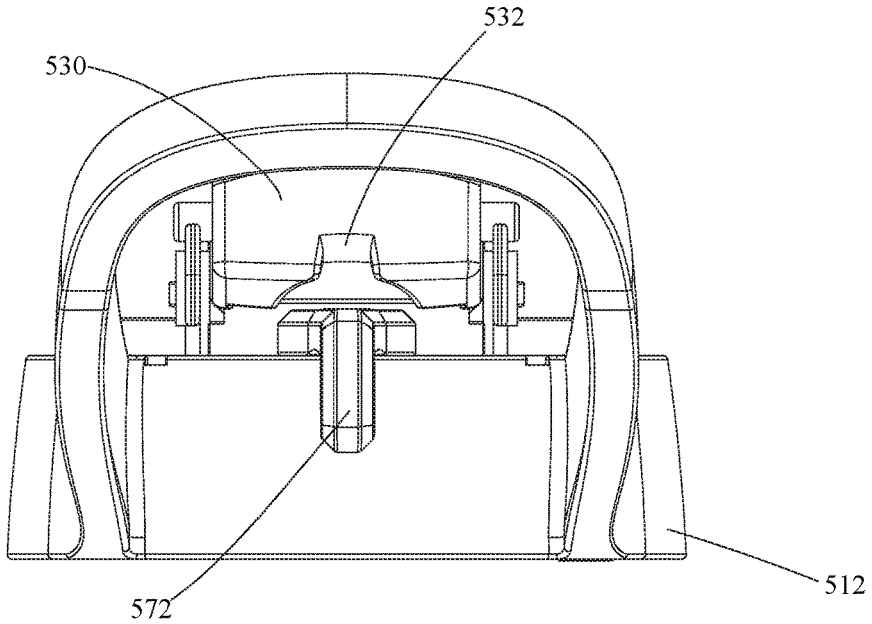
FIG. 15B is a side view illustrating the third embodiment, in which the cover is closed and the arm portion is in the second position.
Figure 16:
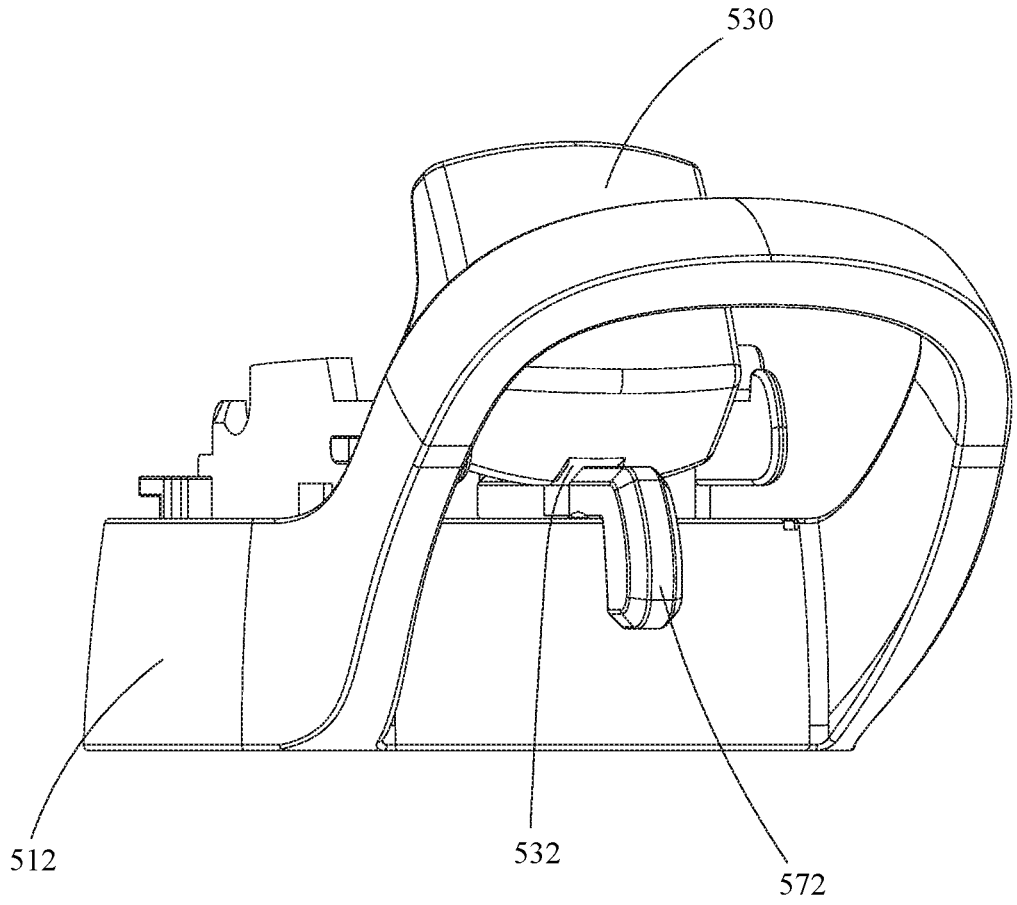
FIG. 16 is a perspective view illustrating the third embodiment, in which the cover is opened and the arm portion is in the second position.

FIGS. 15A-B illustrate the arm portion 572 is configured to stop at its second position, where the arm portion 572 is aligned with the cutout 532, i.e., the interaction means of the cover interacts with the interaction means of the switch 570. It shall be understood that, when the cover 530 undergoes a pivoting movement about holes 517, such movement is allowed since the position of the cutout 532 is superimposed with the arm portion 572, as illustrated in FIGS. 15B and 16.

With description above, it shall be understood that when the spout is in the stowed configuration, the switch 570 in the first position inhibits the movement of the cover 530, which in turn preventing the spout from pivoting upwardly to its dispensing configuration. By turning the switch 570 to its second position, the user pushing the button may cause the spout to move pivotably upwards to its slanted configuration. After the pushing force is released, the button bounces back outwardly to allow the spout pivoting from the slanted configuration to the fully dispensing configuration, as described above.

Figure 17A:
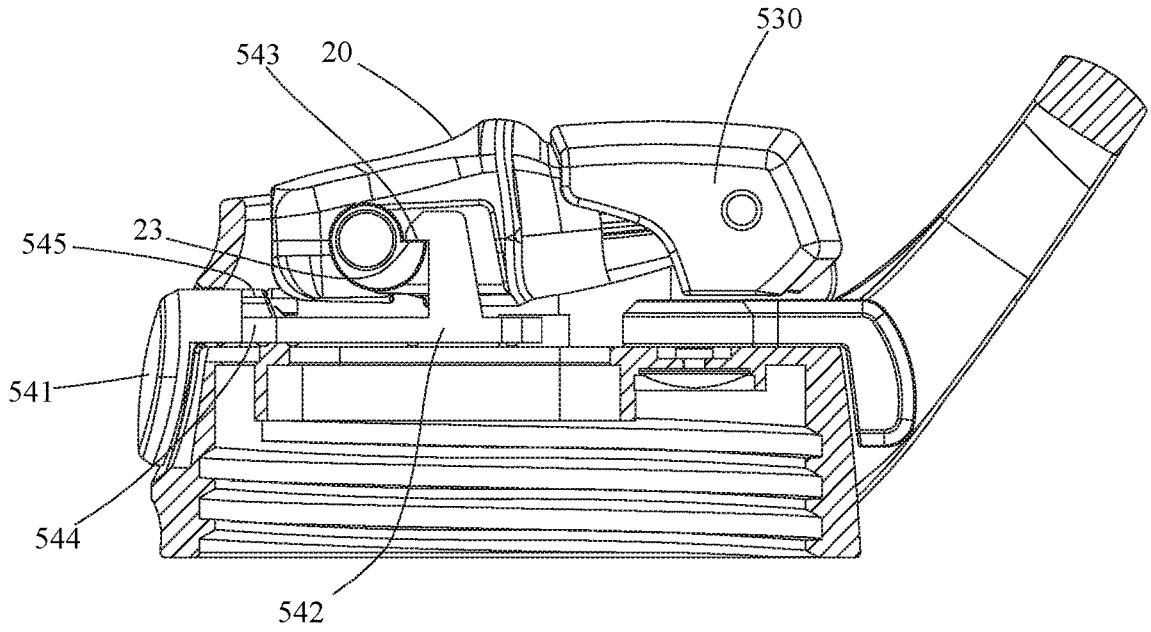
FIGS. 17A-17D are schematic drawings of the lid assembly of the third embodiment with relevant components shown in cross-section, illustrating the movement of the spout from a stowed configuration to a dispensing configuration.
Figure 17B:
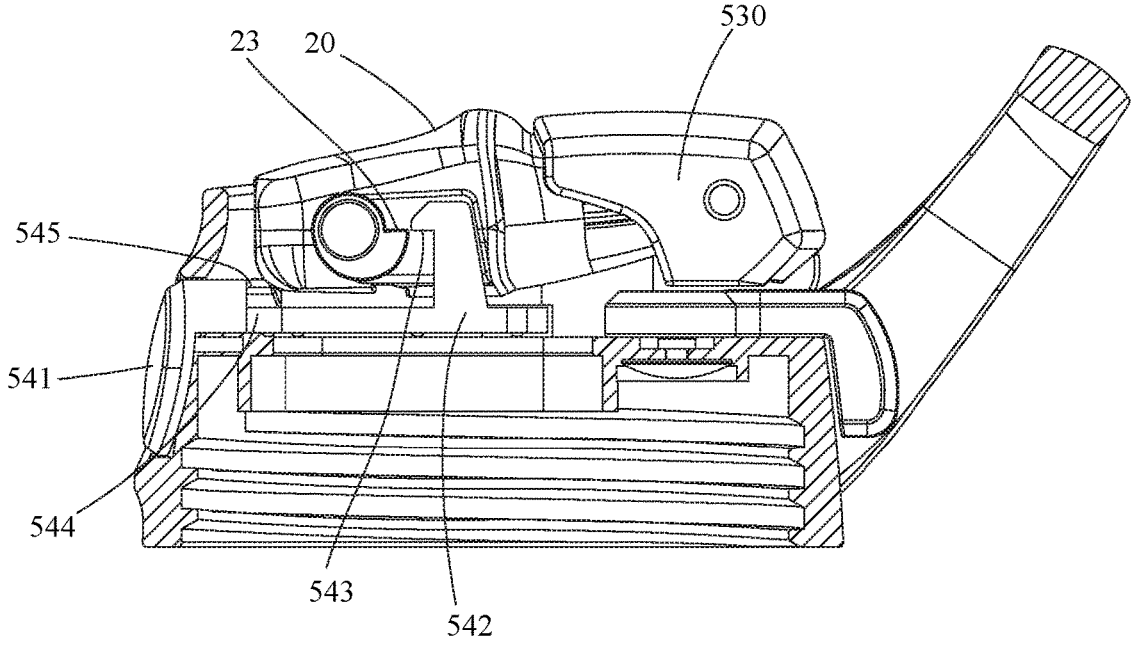
Figure 17C:
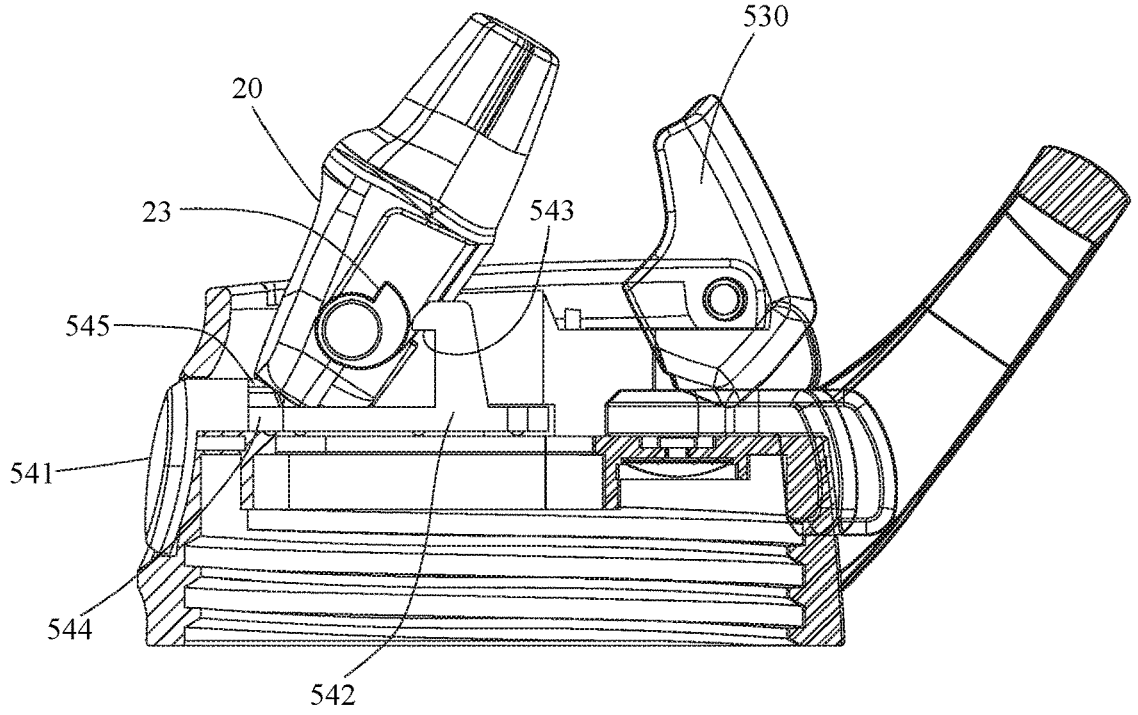
Figure 17D:
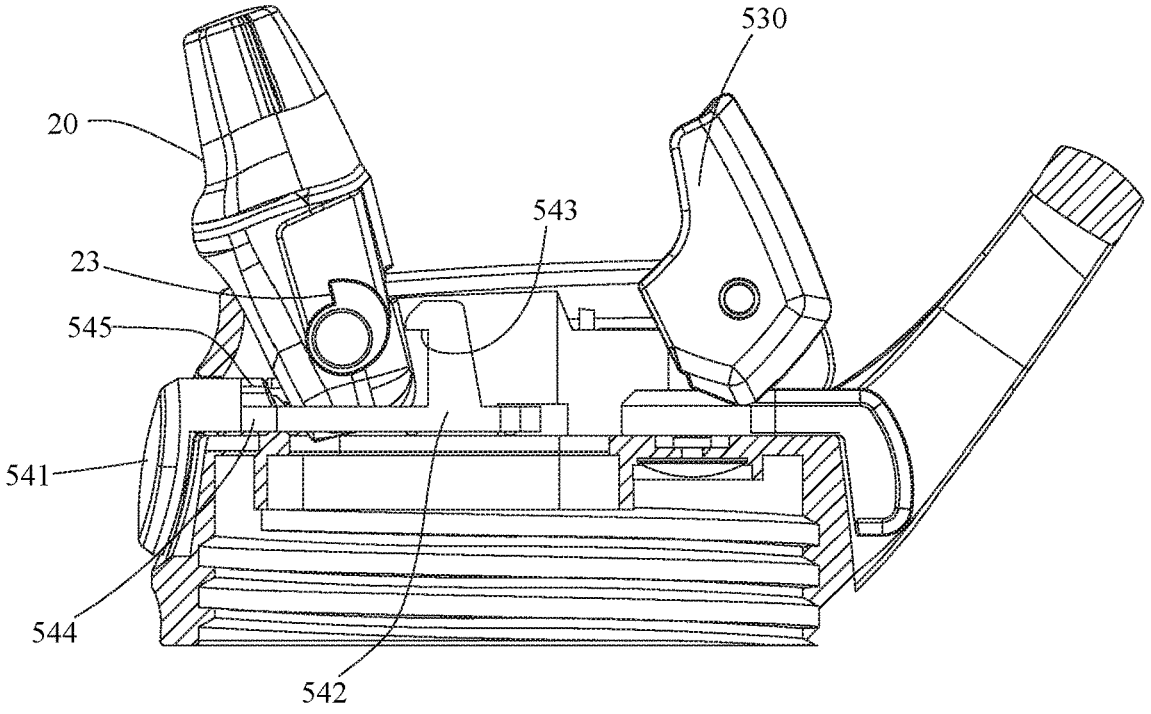

Referring now to FIGS. 17A to 17D, it illustrates the movement of the spout from the stowed configuration to the fully dispensing configuration. As illustrated in FIG. 17A, the spout is in the stowed configuration in which the actuator cam face 543 of the leg 542 is engaged with the spout cam face 22 so as to prevent the spout 20 from pivoting. When the user pushes the button 541 to cause the leg 542 to be displaced in the direction towards the cover 530 until the actuator cam face 543 is disengaged from/with the spout cam face 22 (see FIG. 17B), the spout 20 is not constrained and is thus allowed to move pivotably upwards by the resiliency of its material until the surrounding edge 24 of the spout 20 abuts on a lateral member 544 (interaction means on the trigger mechanism in this embodiment) of the trigger mechanism 540 between the button 541 and the leg 542, preferably abuts on a top surface 545 of the lateral member 544, and the pivoting movement of the spout 20 is stopped before the spout 20 reaches its fully dispensing configuration and the spout 20 is at an acute angle (for example 30° to 60°) relative to the leg 542 and in the slanted configuration, as shown in FIG. 17C. When the user releases the pushing force applied on the button 541, the button 541 is driven by a compression spring (not shown) held in the lid interior to move outwardly away from the surrounding edge 24 of the spout 20, enabling the pivoting movement of the spout 20 further away from the leg 542 to continue until the spout reaches its fully dispensing configuration, as shown in FIG. 17D. Such a two-step mechanism of opening the spout 20 from the stowed configuration to the dispensing configuration constitutes a unique feature of the lid assembly according to this embodiment of the invention.

FIGS. 18-29 illustrate a container lid assembly, a fourth embodiment of the present invention. For brevity's sake, only the differences between the previous embodiments and the fourth embodiment are explained in details. Otherwise, it shall be understood that the operation of the components in the fourth embodiment is substantially the same as the previously explained embodiments.

Figure 18A:
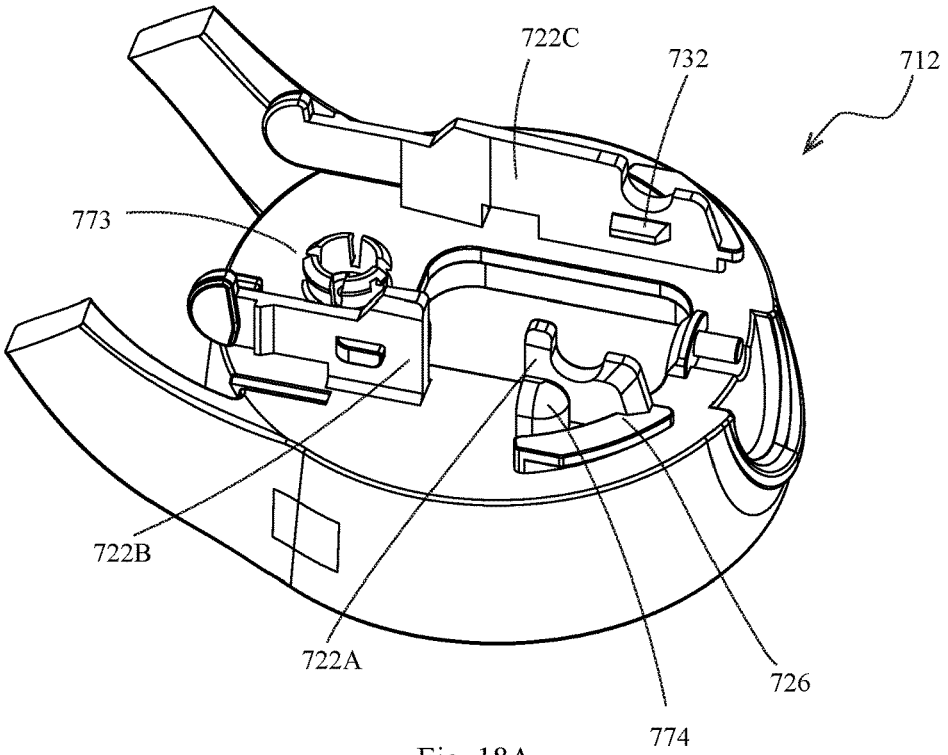
FIGS. 18A-C are different perspective views showing a lower lid of a fourth embodiment of the present invention.
Figure 18B:
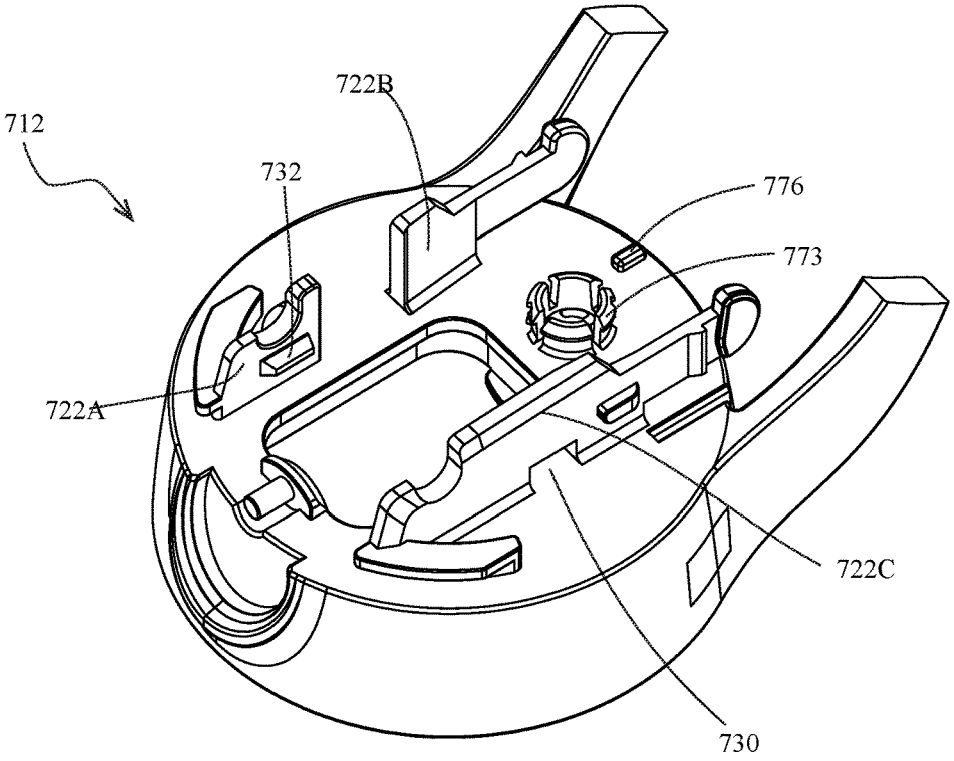

FIGS. 18A and 18B illustrate a lower lid 712 in different perspective view. The lower lid 712 is provided with a first wall member having a first wall 722A and a second wall 722B, and a second wall member 722C. These walls stand from the top surface of the lower lid 712 and are arranged in a symmetric manner on two sides of the through hole of the lower lid 712. The first wall 722A and the second wall 722B are on the same side, which face opposite to the second wall member 722C.

Figure 18C:
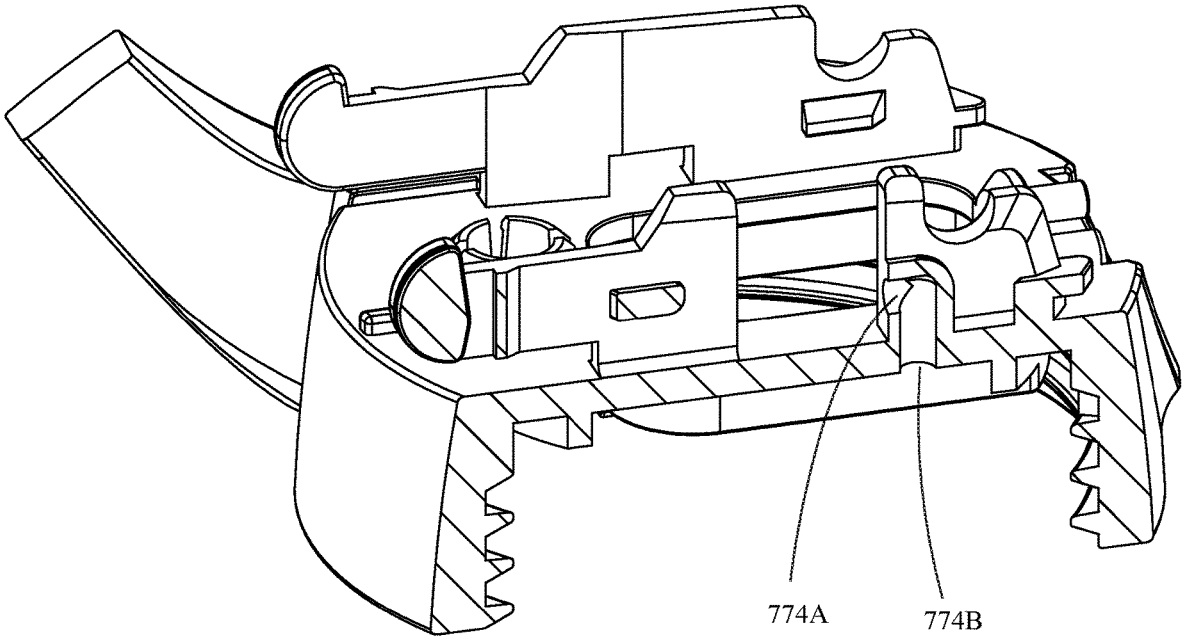

The lower lid 712 is provided with an air channel 774 which is adjacent or adjacent to the first wall 722A and the third protrusion 726 of the lower lid 712. FIG. 18C illustrates the cross-section of the air channel 774 having a first end of the air channel 774A and a second end of the air channel 774B provided on the lower lid 712.

The second end of the air channel 774B is a through hole on the lower lid 712. The first end of the air channel 774A is the opposite end to the second end of the air channel 774B and is arranged above the surface of the lower lid 712. It can be seen that the air channel 774 provides fluid communication between the internal cavity of the container with the lid assembly of the present invention and the atmosphere.

On the inner sides of the first wall 722A and the second wall member 722C, there are provided with a pair of inwardly facing fourth protrusions 732.

Figure 19A:
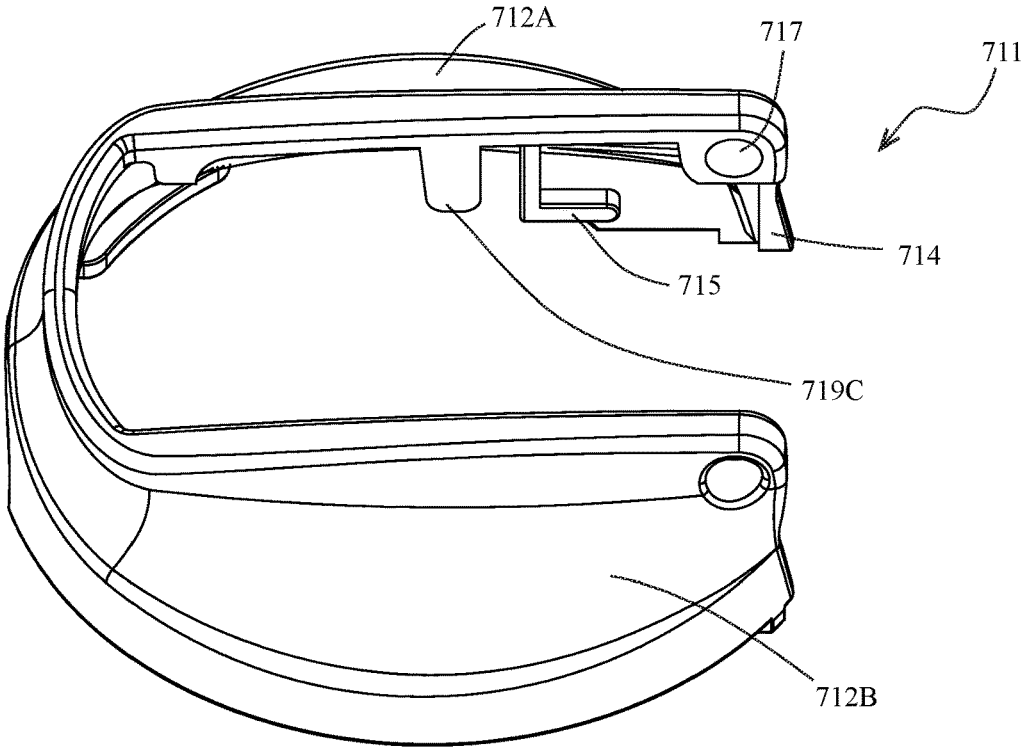
FIGS. 19A-B are different perspective views showing an upper lid of the fourth embodiment.
Figure 19B:
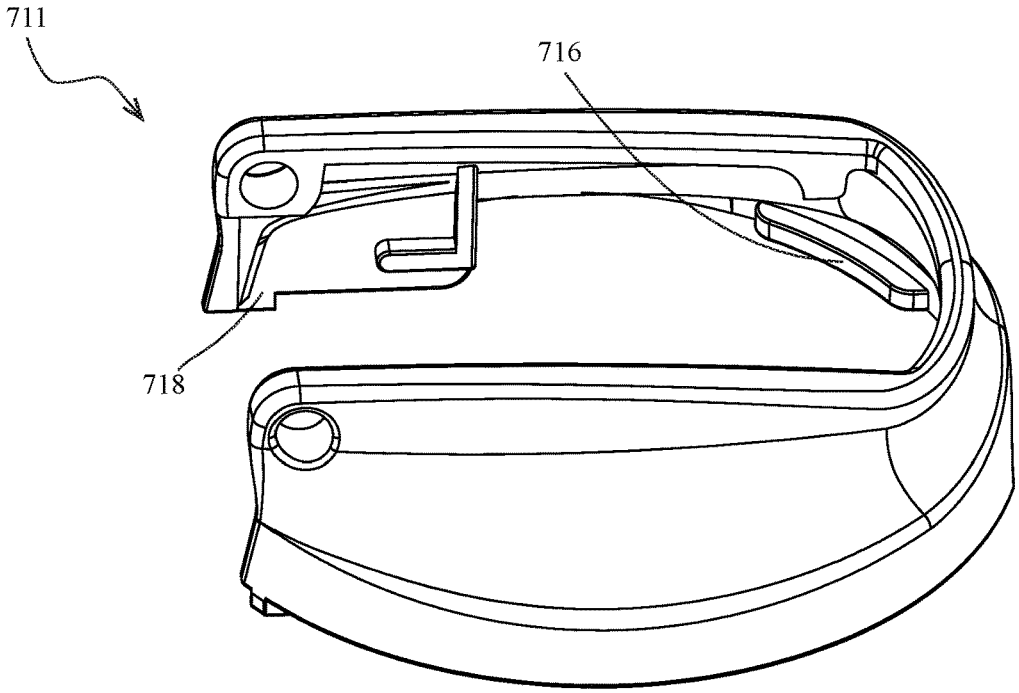

FIG. 19A illustrates that the upper lid 711 is provided with two opposite circumferential walls 712A and 712B.

Each of the walls 712A, 712B is profiled to provide a first protrusion 715, a second protrusion 716, a third protrusion 714, and a leg 718.

Figure 20A:
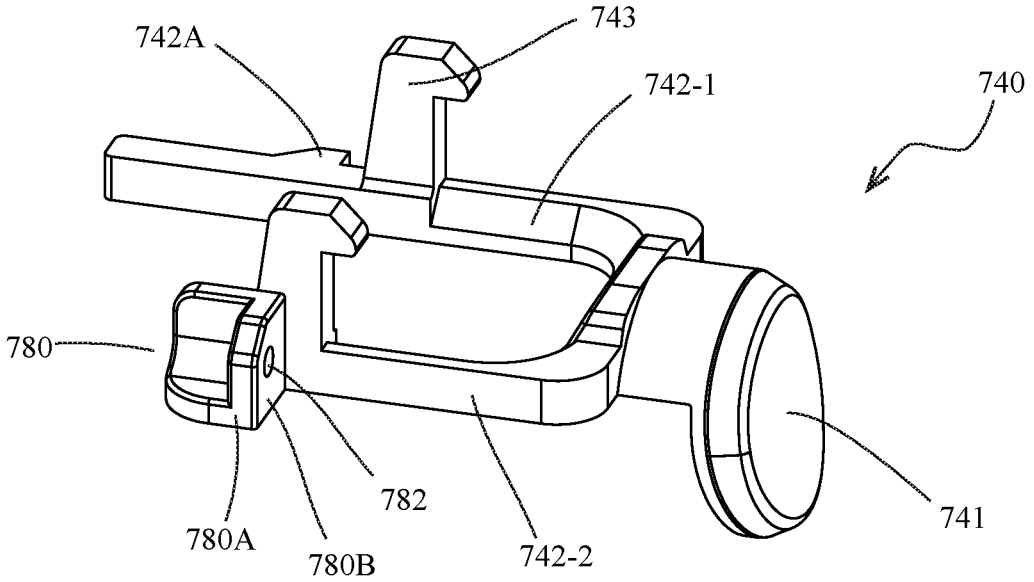
FIGS. 20A-B are different perspective views showing a trigger mechanism of the fourth embodiment.
Figure 20B:
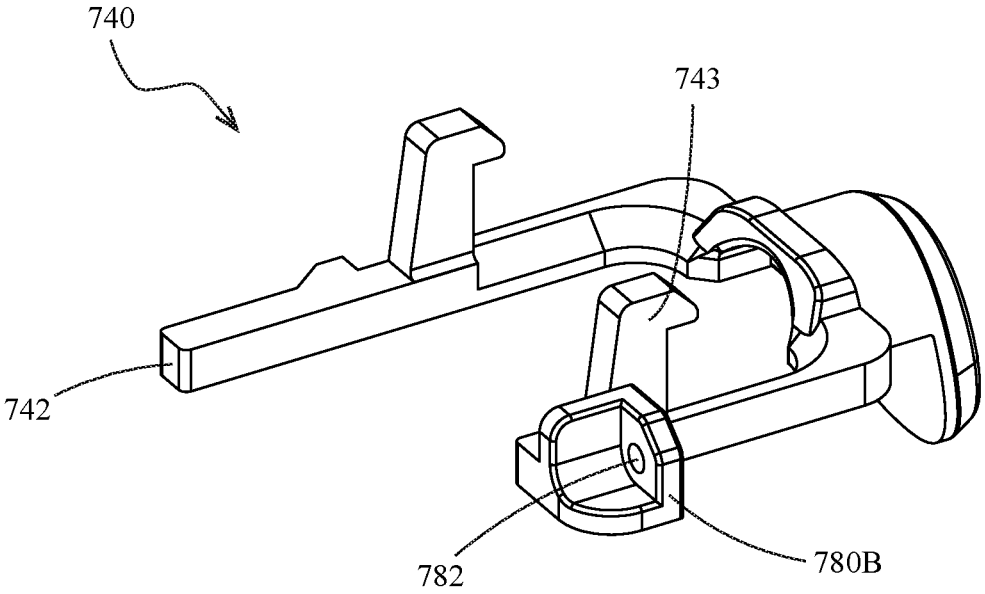

FIGS. 20A and 20B illustrates a trigger mechanism 740, which is one of the embodiments of the trigger mechanism of the present invention. The trigger mechanism 740 comprises a first portion and a second portion joining with the first portion. The first portion includes a button 741. The second portion includes a pair of legs 742 in bifurcation extending away from the first portion. The legs 742 comprises a first leg 742-1 and a second leg 742-2, wherein the first leg 742-1 is longer than the second leg 742-2, as illustrated in FIG. 20A. One shall note the importance of the longer portion of the first leg 742-1 then the second leg 742-2, which is an example of a locking means provided to the trigger mechanism 740. The operation of the locking means will be explained in details later. The legs 742 each is provided with an actuator cam face 743 projecting upwards from the legs 742.

The first leg 742-1 is provided with a protrusion 742A, which corresponds to the position of the passage 730 of the lower lid 712. The passage 730 is defined as an aperture in figure. However it shall be understood that the passage 730 can also be a groove.

The second leg 742-2 is provided with a receptacle 780 at the end of the second leg 742-2.

The receptacle 780 comprises a bottom wall 780A and vertical walls 780B. The vertical walls 780B adjoins the second leg 742-2 and is provided with a through hole 782.

Figure 21:
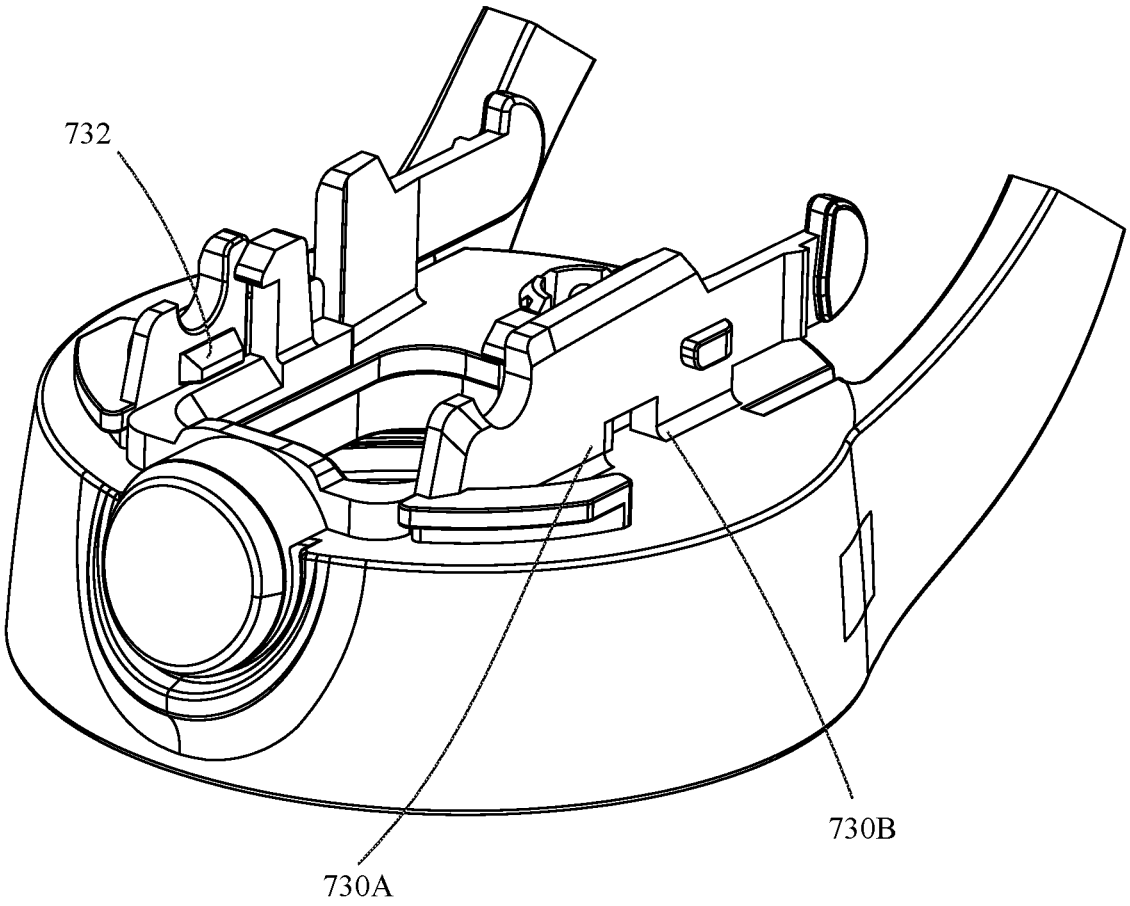
FIG. 21 is a first perspective view illustrating the assembling of the trigger mechanism to the lower lid.

FIG. 21 illustrates a first perspective view illustrating the assembling of the trigger mechanism 740 to the lower lid 712. It can be seen the fourth protrusion 732 sits over the second leg 742-2, thus aiding to hold the legs of the trigger mechanism 740 into position during the sliding of the trigger mechanism 740. Further, as indicated in FIG. 19A, wall 712A is provided with a stopper 719C adjacent or adjacent to the first protrusion 715. The stopper 719C aid at holding the legs of the trigger mechanism 740, in particular the second leg 742-2 into position during the sliding of the trigger mechanism 740.

It can also be seen that the protrusion 742A on the first leg 742-1 is received in the passage 730 and is able to slide between the first trigger position where the protrusion 742A is at the first end 730A of the passage 730 and the second trigger position where the protrusion 742A is at the second end 730B of the passage 730.

Figure 22:
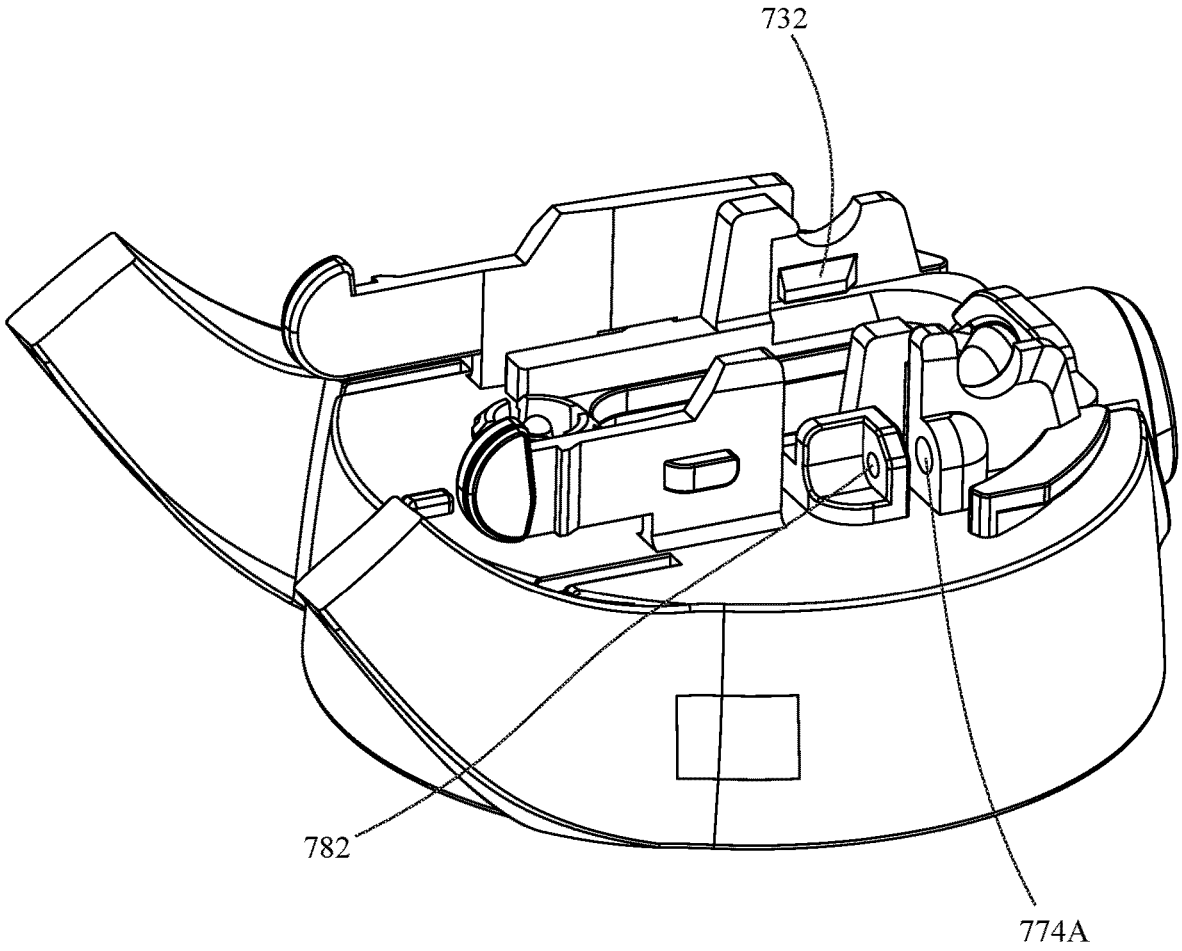
FIG. 22 is a second perspective view illustrating the assembling of the trigger mechanism to the lower lid.

FIG. 22 illustrates a second perspective view illustrating the assembling of the trigger mechanism 740 to the lower lid 712. It can be seen that the position of the through hole 782 aligns with the position of the first end of the air channel 774A. It can be understood that when the trigger mechanism 740 moves between the first trigger position and the second trigger position, the through hole 782 is adjacent or adjacent to the first end of the air channel 774A and away from the first end of the air channel 774A, respectively.

Figure 23A:
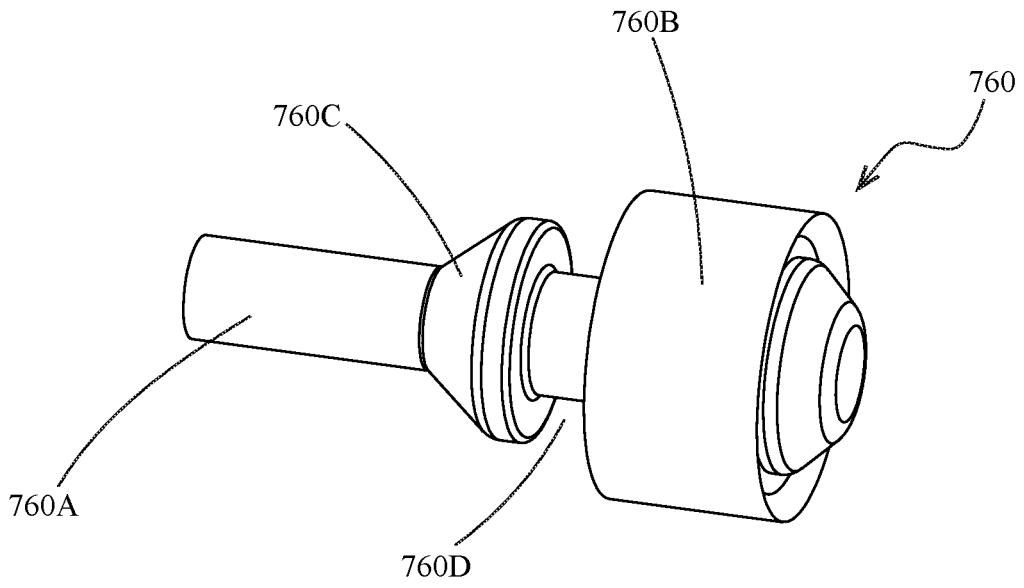
FIGS. 23A-B are perspective views showing a plug of the fourth embodiment.
Figure 23B:
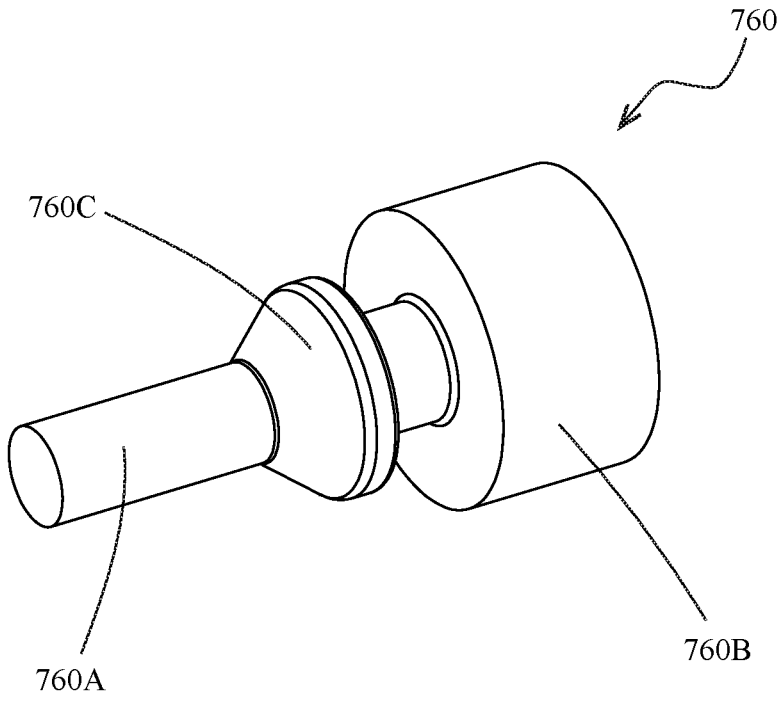

FIG. 23A and FIG. 23B illustrate a plug 760 with different perspective views. The plug 760 has a first portion 760A, an enlarged second portion 760B, and a middle portion 760C connecting the first portion 760A and the second portion 760B. Advantageously, the plug is made of resilient and/or elastic material.

Figure 24A:
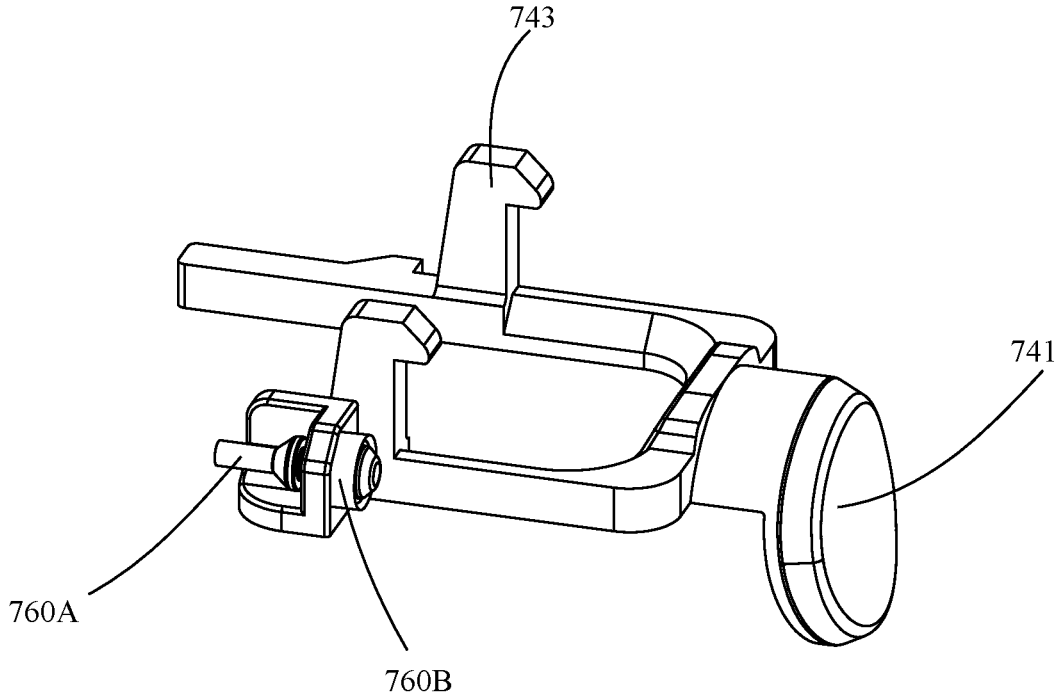
FIGS. 24A-B are different perspective views showing the assembling of the plug to the receptacle of the trigger mechanism.
Figure 24B:
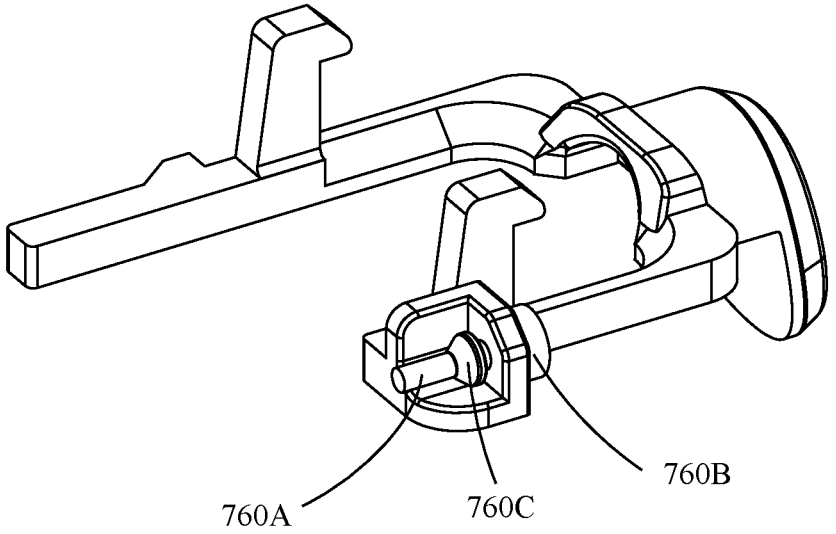

FIGS. 24A and 24B illustrates the assembling of the plug 760 to receptacle 780 of the trigger mechanism 740 with different perspective views. The plug 760 can be assembled to the receptacle 780 for example by positioning the plug 760 close to a side adjacent or adjacent to the button 741 of the vertical wall 780B, aligning the first portion 760A of the plug 760 with the through hole 782, and then snugly fitting the plug 760 into the through hole 782. As shown in FIGS. 24A and 24B, the plug 760 is secured to the receptacle 780 in which the groove 760D of the plug 760 (see FIG. 23A) is received in the through hole 782, the first portion 760A and the middle portion 760C of the plug 760 is on one side of the receptacle 780, and the second portion 760B of the plug 760 is on the other side of the receptable 780, i.e., the side close to the button 741.

Figure 25:
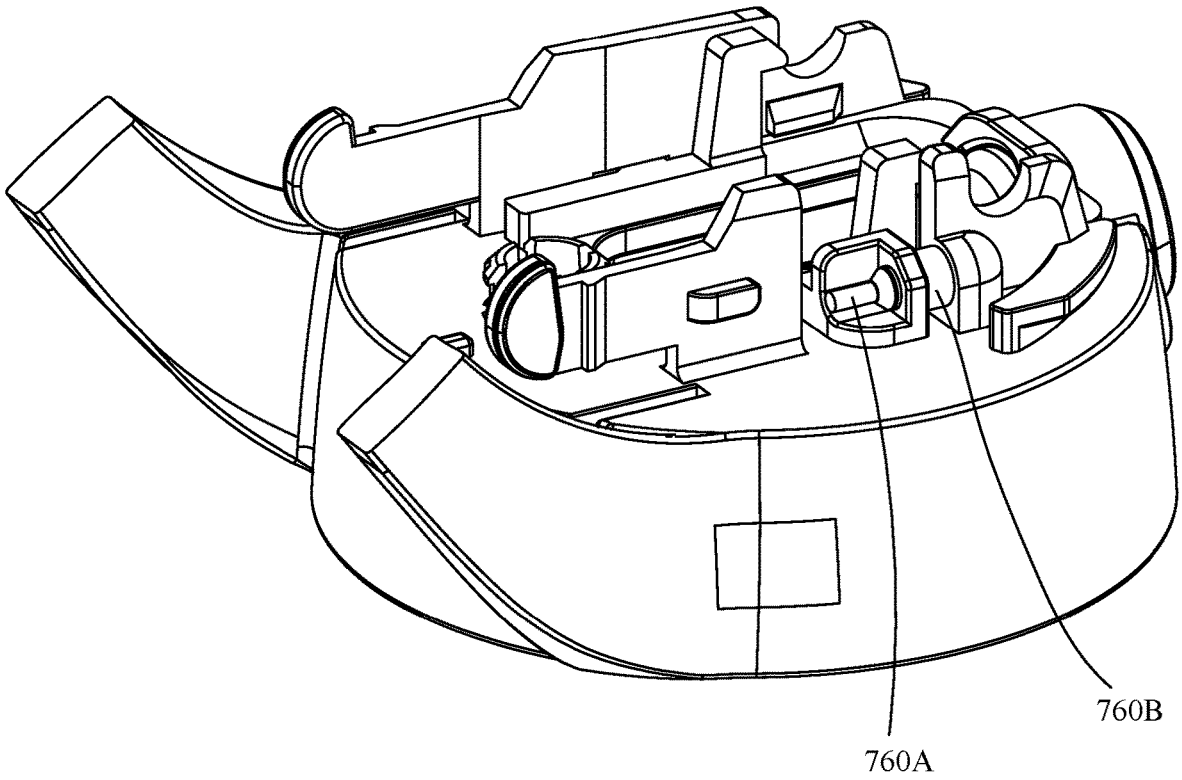
FIG. 25 is a perspective view showing the assembly between the lower lid, the trigger mechanism, and the plug.

FIG. 25 illustrates the assembly between the lower lid 712, the trigger mechanism 740, and the plug 760. It can be understood that when the trigger mechanism 740 moves between the first trigger position and the second trigger position, the second portion 760B of the plug 760 is adjacent or adjacent to the first end of the air channel 774A and away from the first end of the air channel 774A, respectively. Referring to FIG. 23A, it illustrates that the second portion 760B is profiled to fit the first end of the air channel 774A. When the second portion 760B engages with the first end of the air channel 774A, the second portion 760B blocks the air channel 774. In other words, it can be understood that when the trigger mechanism 740 moves between the first trigger position where the air channel 774 is blocked and the second trigger position where the air channel is opened, pressure inside the container is able to release to the atmosphere. Therefore, the fourth embodiment is in particular suitable to keep hot beverage.

The fourth embodiment comprises the air channel 774 and the plug 760, providing an advantage that the air channel 774 opens before the spout assumes its second configuration or slanted configuration, as described above in the previous first to third embodiments. It enhances releasing hot air pressure accumulated inside the container before the spout of container is fully opened, so as to avoid the user being burned by the ejected hot air.

Figure 26A:
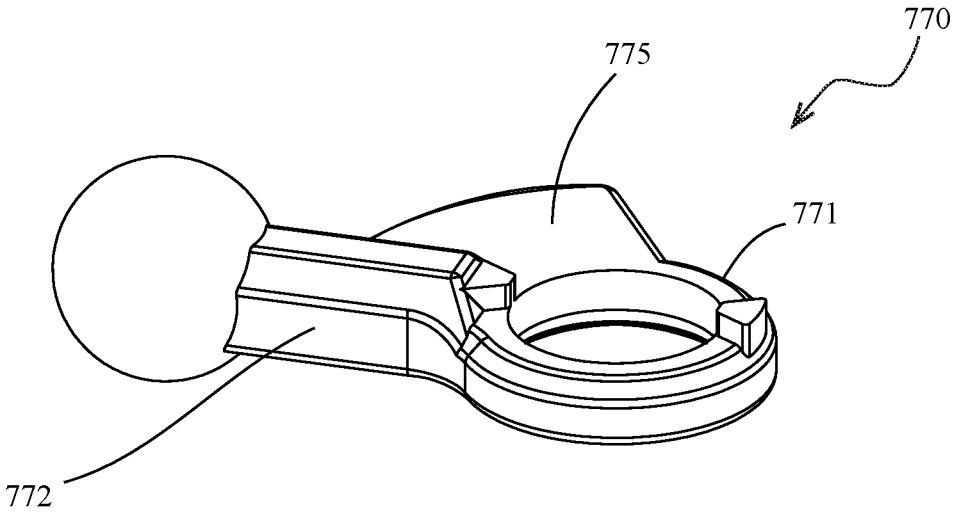
FIGS. 26A-B are different perspective views showing a switch of the fourth embodiment.
Figure 26B:
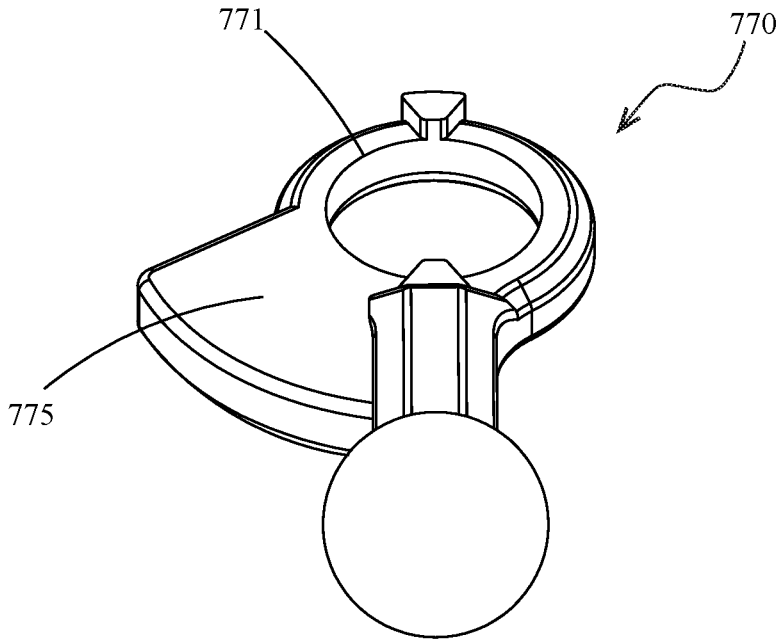

FIGS. 26A and 26B illustrates the switch 770 of the fourth embodiment. It can be seen that the switch 770 is provided with a plate 775 connecting the ring-shaped head 771 and the arm portion 772. One shall note the importance of the plate 775, which is an example of a locking means provided to the switch 770. The operation of the locking means will be explained in details later. One shall understand that the plate 775 is an example of the locking means provided to the switch only, and shall not construed as limitation the present invention.

Figure 27:
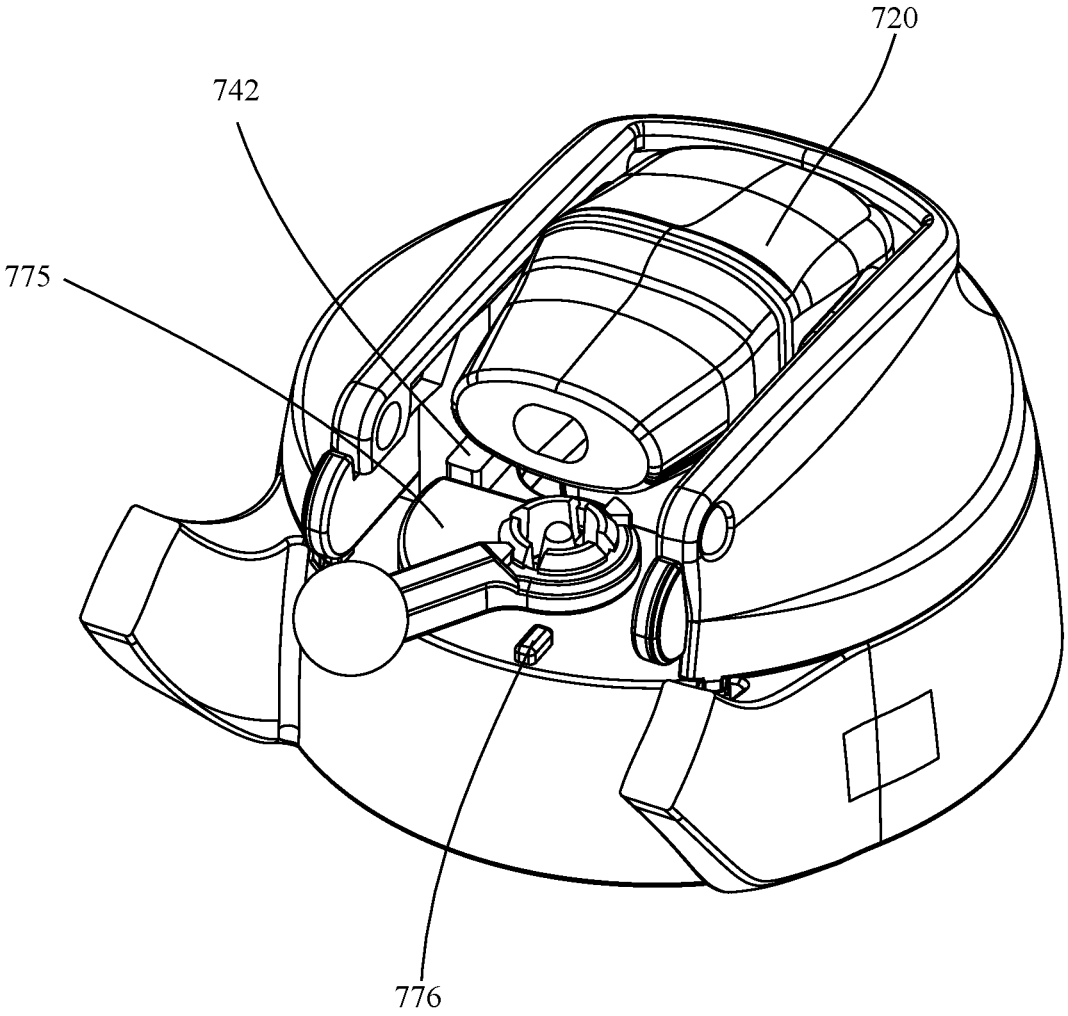
FIG. 27 is a perspective view showing the switch in its first position.
Figure 28:
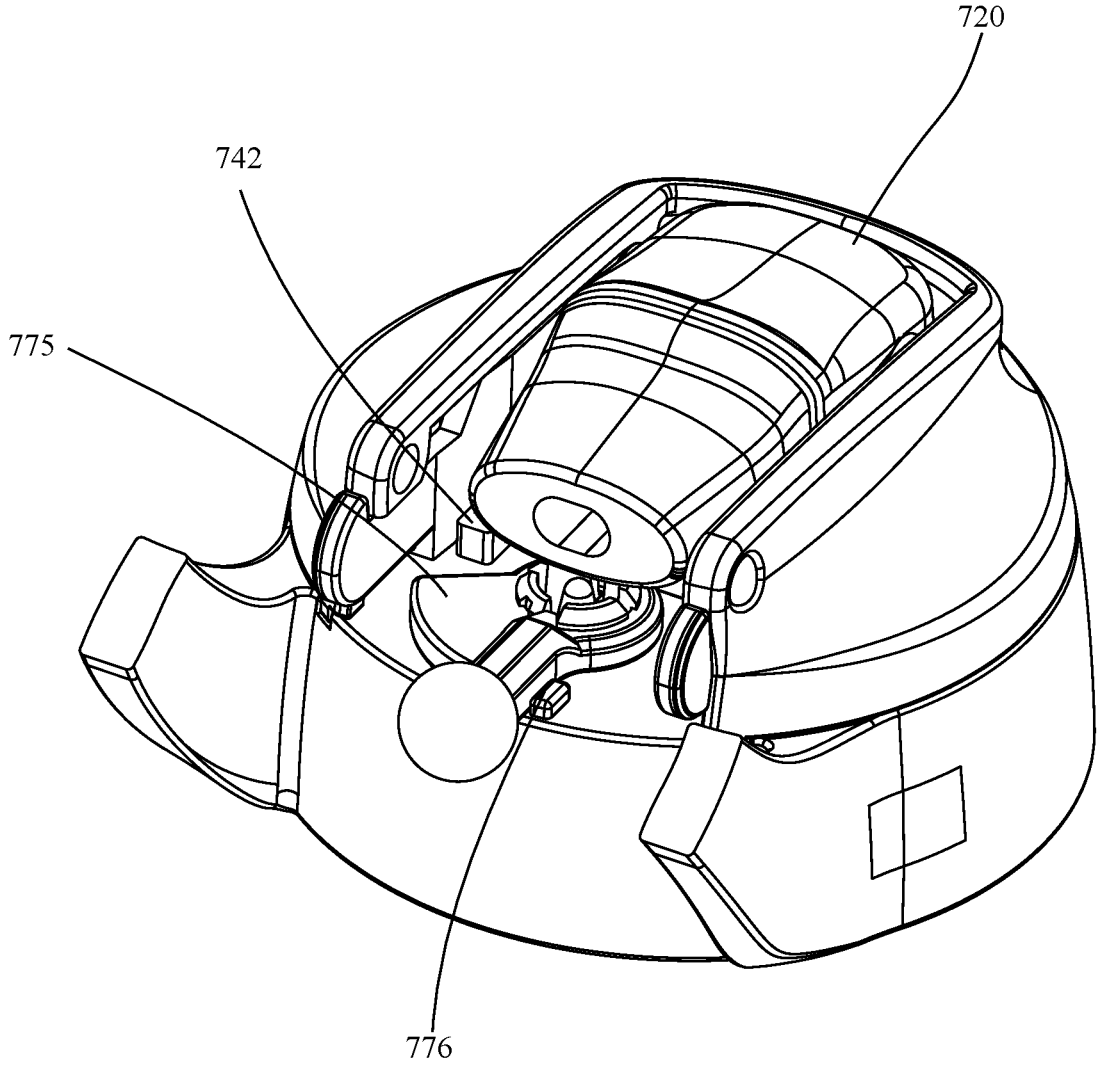
FIG. 28 is a perspective view showing the switch in its second position.

FIGS. 27 and 28 illustrate the assembling of the switch 770 in the lid assembly of the present invention.

The switch 770 in FIG. 27 is in a first position where the plate 775 is adjacent or adjacent to the end of the leg 742-2, whereby inhibiting or limiting the movement of the trigger mechanism 740. In other words, it shall be understood that the locking means of the switch 770 engages with the locking means of the trigger mechanism 740, thus maintaining the trigger mechanism at the first trigger position even a user pushes the button 741.

Figure 29A:
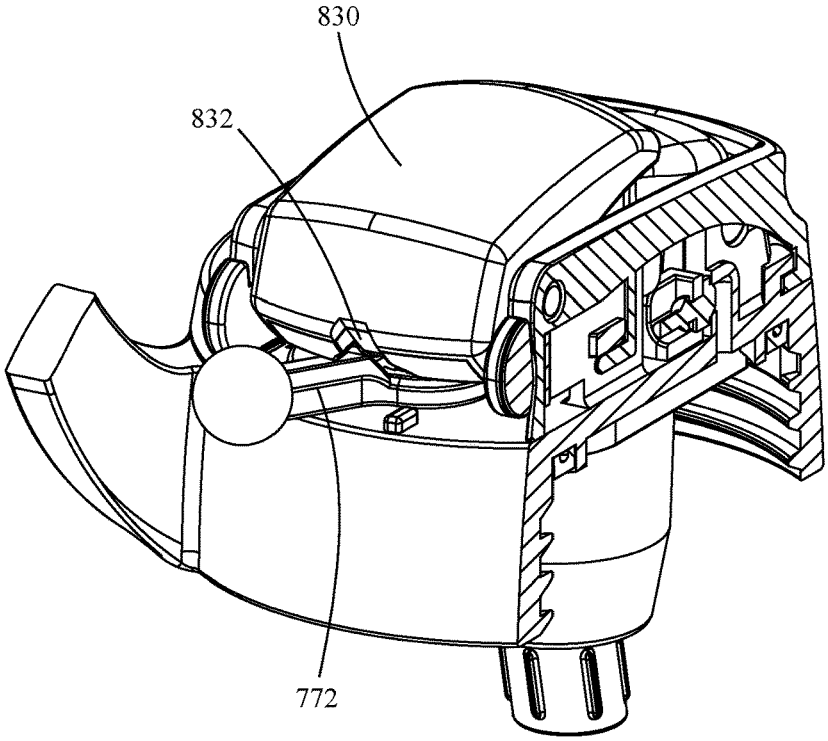
FIG. 29A is a perspective view showing the switch in its first position.

FIGS. 27 and 29A illustrate the arm portion 772 is configured to stop at its first position, where the arm portion 772 is misaligned with the cutout 832, i.e., the interaction means of the cover does not interact with the interaction means of the switch 770. It shall be understood that, when the cover 830 undergoes a pivoting movement about holes 717, such movement is hindered by the arm portion 772.

Figure 29B:
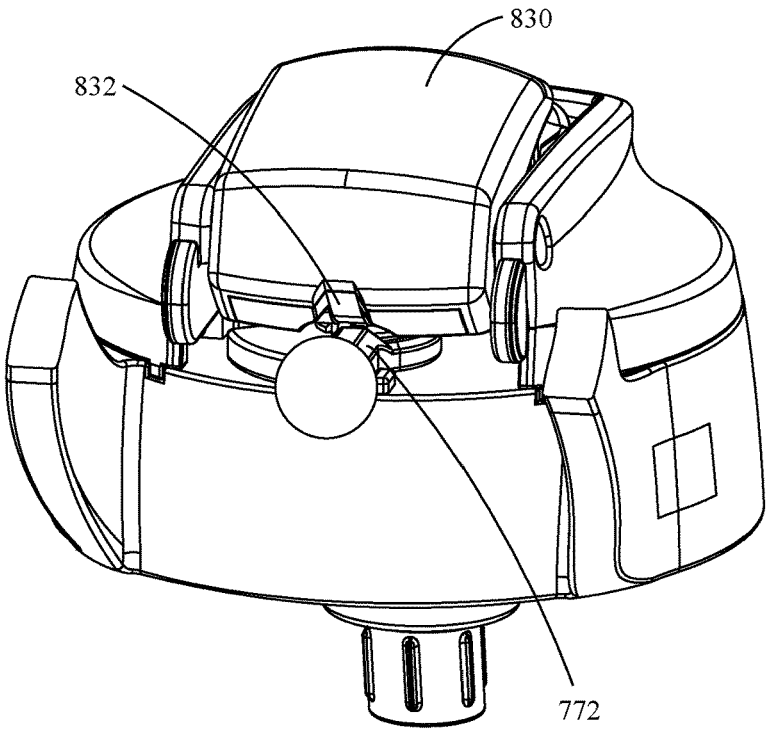
FIG. 29B is a perspective view showing the switch in its second position.

The switch 770 in FIGS. 28 and 29B is in a second position where the plate 775 is away from the end of the leg 742-2, whereby providing a space allowing the trigger mechanism 740 to move from the first trigger position to the second trigger position. In other words, it shall be understood that the locking means of the switch 770 does not engage with the locking means of the trigger mechanism 740, thus allowing the trigger mechanism to move between from said first trigger position to said second trigger position when a user pushes the button 741.

On the top surface of the lower lid 712 is provided with a fifth protrusion 776 for limiting the movement of the switch 770 about the bushing 773, such that when the switch 770 is in its second position as shown in FIGS. 28 and 29B, the position of the arm portion 772 aligns with the cutout 832 of the cover 830. When the cover 830 undergoes a pivoting movement about holes 717, such movement is allowed since the position of the cutout 832 is superimposed with the arm portion 772.

Figure 30A:
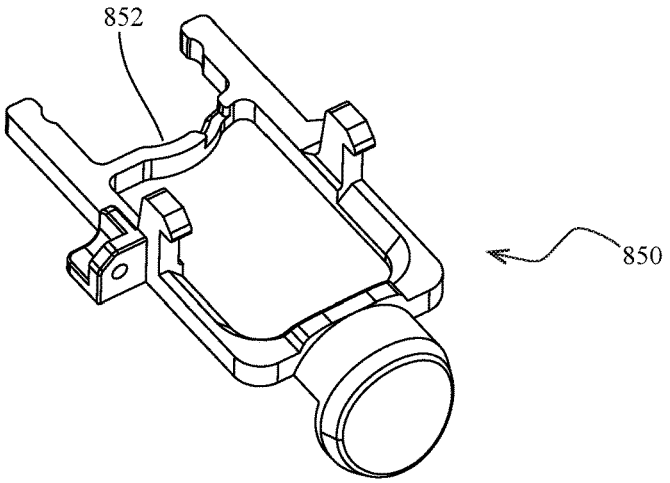
FIGS. 30A-C shows another embodiment of the trigger mechanism of the present invention in different perspective views.
Figure 30B:
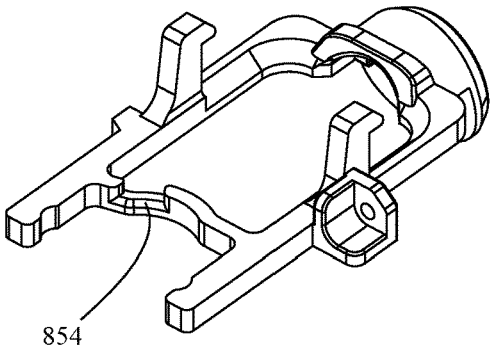
Figure 30C:
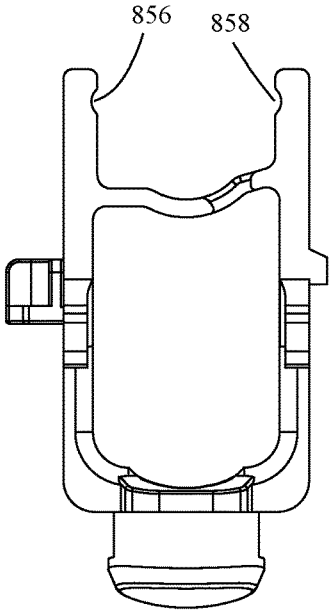

FIGS. 30A-C shows another embodiment of the trigger mechanism of the present invention in different perspective views. The trigger mechanism 850 in FIGS. 30A-D is provided with a bridge member 852 connecting the two legs of the trigger mechanism. The bridge member 852 comprises a notch 854. The inner side of the legs of the trigger mechanism 850 is provided with a recessed portions 856 and 858 at the distal end of the legs.

Figure 31A:
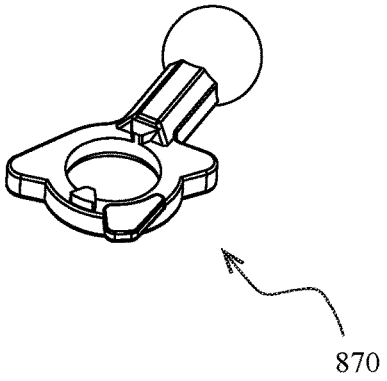
FIGS. 31A-C shows another embodiment of the switch of the present invention in different perspective views.
Figure 31B:
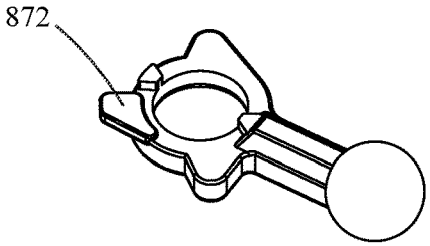
Figure 31C:
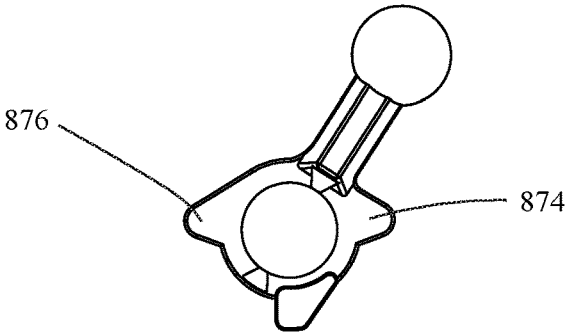

FIGS. 31A-C shows another embodiment of the switch of the present invention in different perspective views. The switch 870 in FIGS. 31A-C comprises a ring-shaped head having a first protrusion 872, a second protrusion 874, and a third protrusion 876. In these figures, the second protrusion 874 and the third protrusion 876 are arranged diagonally however it shall not be construed as limitation to the invention.

It shall be understood that the operation of the components in FIGS. 30-31 are substantially the same as the previously explained embodiments. For brevity's sake, only the differences between the components in FIGS. 30-31 and the previous embodiments are explained in details.

Figure 32B:
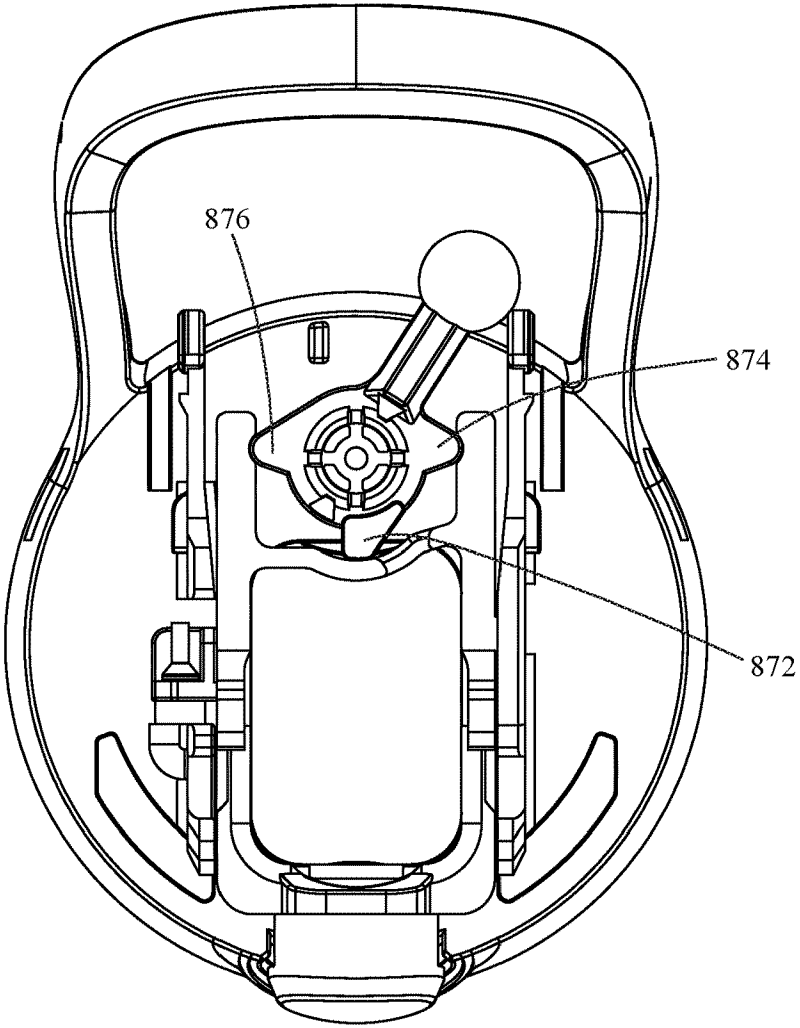
FIG. 32B is an elevation view showing the switch in its first position.
Figure 32A:
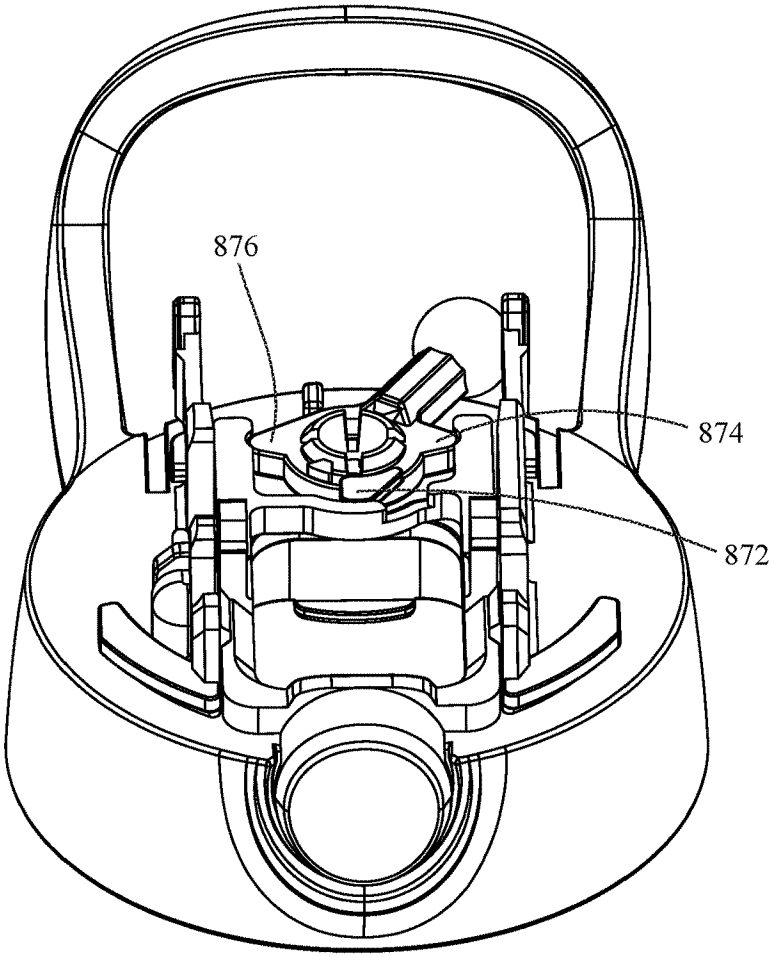
FIG. 32A is a perspective view showing the switch in its first position.
Figure 33B:
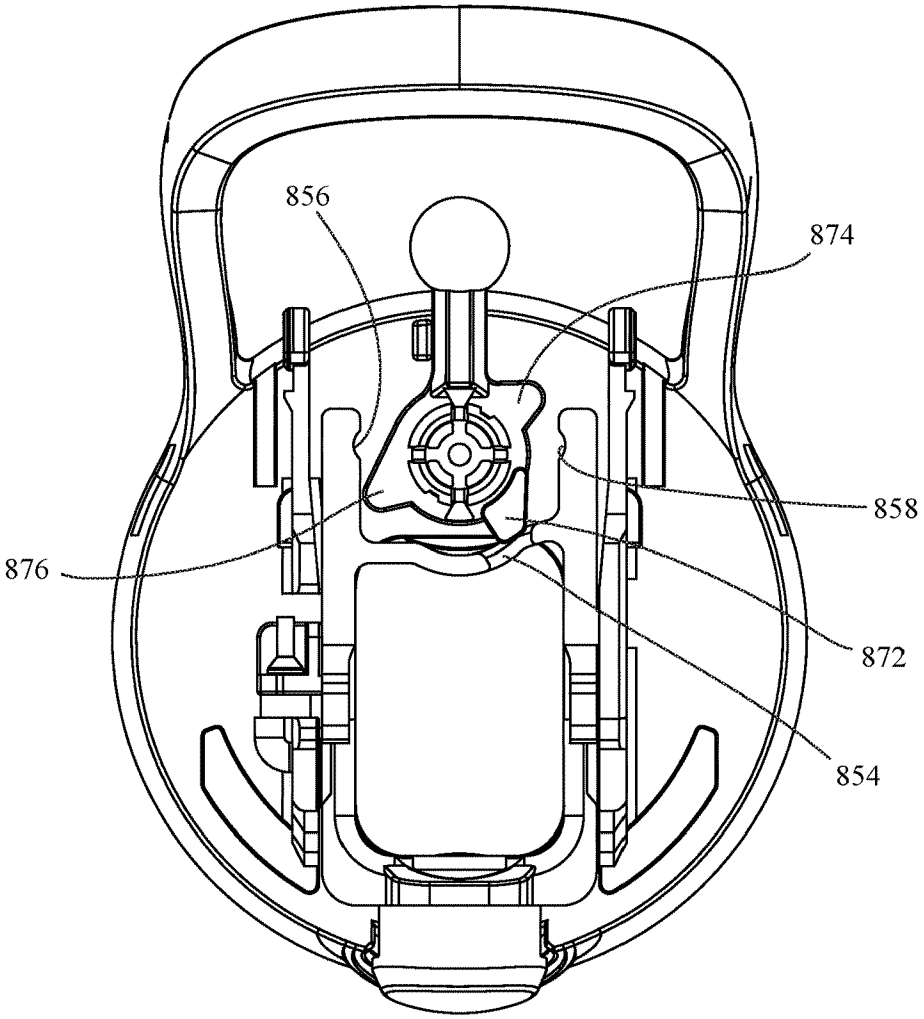
FIG. 33B is an elevation view showing the switch in its second position.
Figure 33A:
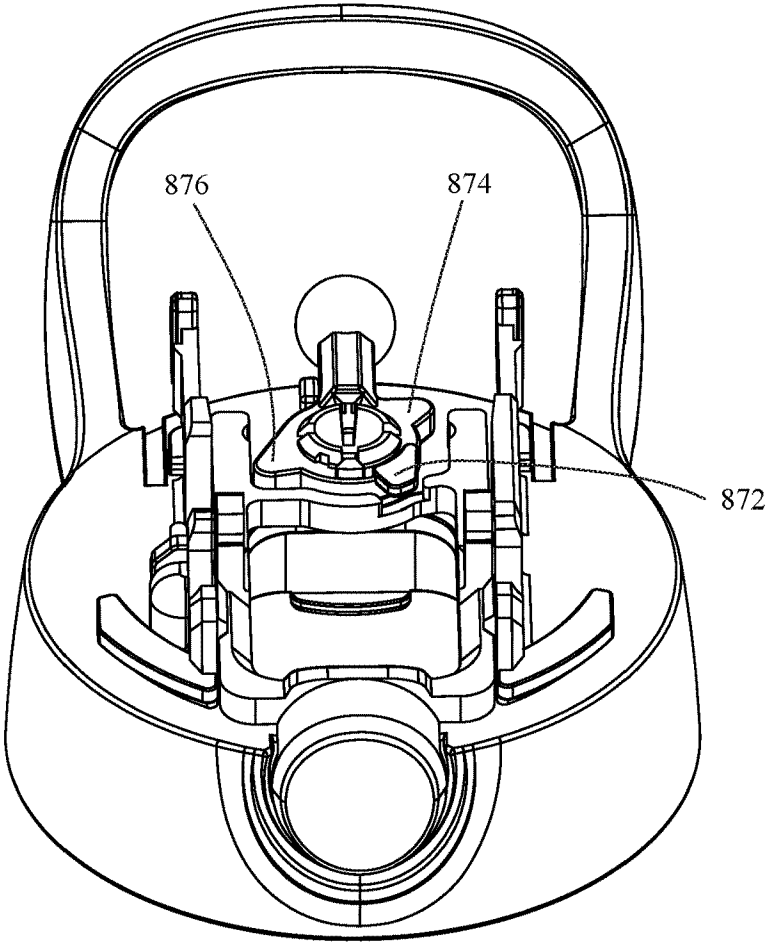
FIG. 33A is a perspective view showing the switch in its second position.

FIGS. 32-33 show the assembling of the trigger mechanism 850 and the switch 870 to the lower lid of the present invention. The switch 870 in FIGS. 32A and 32B is in its first position, as described above. The switch 870 in FIGS. 33A and 33B is in its second position.

With description above in the previous embodiments, it shall be understood that the switch 870 is configured to rotate about the bushing provided on the top surface of the lower lid between its first and second positions. Therefore, to facilitate such rotation, the bridge member 852 is designed curved following the rotation trajectory of the first protrusion 872. In FIGS. 32A-B, it can be seen that the first protrusion 872 engages with the bridge member 852. It can also be seen that the second protrusion 874 and the third protrusion 876 of the switch 870 engage with the recessed portions 856, 858, respectively, of the trigger mechanism 850. Therefore, with the engagement between the three protrusions of the switch and the trigger mechanism, the trigger mechanism cannot be moved even a user pushes the button of the trigger mechanism. In other words, the trigger mechanism 850 remains in its first trigger position even a user pushes the button of the trigger mechanism.

When the switch 870 rotates to its second position about the bushing, it become in a state as showed in FIGS. 33A and 33B. As illustrated, the three protrusions of the switch disengage with/from the trigger mechanism. It can be seen that the size, the shape, the position of the first protrusion 872 of the switch 870 now correspond to the size, the shape, the position of the notch 854 of the trigger mechanism 850. Therefore, when a user pushes the button of the trigger mechanism, which can be allowed to move from its first trigger position to its second trigger position.

It shall be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. Also, a skilled person in the art would be aware of the prior art which is not explained in the above for brevity purpose. It is to be noted that certain features of the embodiments are illustrated by way of non-limiting examples. For example, the size and shape and position of the disclosed components can be adaptively changed to cater different users' need. The disclosed components are all examples to illustrate the present invention only and shall not construe as limiting to the scope of protection. Those skilled in the art could adjust and/or modify these components according to actual needs, and variations therefrom also fall into the scope of the present invention.

What is claimed is:

1. A lid assembly, for a container, comprising:

a first lid;

a second lid, removably connected to said first lid;

a trigger mechanism, slidably connected to said second lid to slide between a first trigger position and a second trigger position, is provided with a first interaction means and a first engagement means; and a spout, pivotably connected to said second lid, is provided with a second interaction means and a second engagement means, wherein the pivoting movement of said spout is controlled by the operation of said trigger mechanism;

characterized in that, said lid assembly is configured:

a first configuration in which said trigger mechanism being at said first trigger position and said spout being at a first spout position, wherein said first engagement means engaging with said second engagement means, and said first interaction means not interacting with said second interaction means;

a second configuration in which said trigger mechanism being at said second trigger position and said spout being at a second spout position, wherein said first engagement means not engaging with said second engagement means, and said first interaction means interacting with said second interaction means; or a third configuration in which said trigger mechanism being at said first trigger position and said spout being at a third spout position, wherein said first engagement means not engaging with said second engagement means, and said first interaction means not interacting with said second interaction means.

2. The lid assembly as claimed in claim 1, in which, said trigger mechanism comprising a first portion and a second portion adapted in a bifurcation form having a pair of legs, at least one of the legs is provided with an actuator cam face defining said first engagement means; and a cam face provided on the lateral side of said spout defining said second engagement means, wherein said actuator cam face and said cam face are on the same side.

3. The lid assembly as claimed in claim 2, wherein:

said second lid is provided with a pair of oppositely facing vertical wall members, at least one of said wall member is provided with a passage; and at least one of said legs of said trigger mechanism is provided with a protrusion corresponding to said passage of said second lid, such that said trigger mechanism is slidable in said passage between said first trigger position and said second trigger position.

4. The lid assembly as claimed in claim 3, wherein said passage is a groove or an aperture.

5. The lid assembly as claimed in claim 3, said lid assembly further comprising a position system enabling the removable connection between said first lid and said second lid, wherein said position system is formed by at least one selected from a group comprising:

a first protrusion extending along a portion of an inner surface of a circumferential wall of said first lid, collaboratively operating with a first protrusion extending along a portion of a perimeter on a top surface of said second lid;

a leg extending from the bottom side of said first lid, collaboratively operating with a groove on the top surface of said second lid;

a second protrusion on the inner surface of the circumferential wall of said first lid defining an aperture, collaboratively operating with a second protrusion on said vertical wall member of said second lid;

a third protrusion provided to said first lid extending along the height of the circumferential wall to an extent collaboratively operating with a third protrusion at a manipulation end of said vertical wall member of said second lid; and a recess on or adjacent or adjacent to the bottom side of said first lid, collaboratively operating with a fourth protrusion on a top side of said second lid.

6. The lid assembly as claimed in claim 5, wherein said manipulation end of said vertical wall member is made of resilient material.

7. The lid assembly as claimed in claim 3, wherein said first lid is provided with a stopper for facilitating the sliding of the legs of said trigger mechanism.

8. The lid assembly as claimed in claim 3, wherein at least one of said vertical wall members of said second lid is provided with a sixth protrusion for facilitating the sliding of the legs of said trigger mechanism.

9. The lid assembly as claimed in claim 3, in which, said switch comprising a plate, wherein:

when said switch being in said first position, said plate being adjacent or adjacent to the end of one of the legs of said trigger mechanism, thereby limiting the movement of said trigger mechanism; and when said switch being in said second position, said plate being away from the end of one of the legs of said trigger mechanism, thereby allowing the movement of said trigger mechanism.

10. The lid assembly as claimed in claim 2, in which, said trigger mechanism is provided with a bridge member connecting with the pairs of legs of said trigger mechanism, wherein said bridge member having a notch provided thereon; at least one of the legs of said trigger mechanism is provided with a recessed portion on the side facing said switch; said switch comprising a first protrusion and a second protrusion, wherein:

when said switch in said first position, said first protrusion and said second protrusion of said switch engaging with said bridge member and said recessed portion, respectively, thereby limiting the movement of said trigger mechanism;

when said switch in said second position, said first protrusion and said second protrusion of said switch disengaging with said bridge member and said recessed portion, respectively; and a position of said first protrusion of said switch being aligned with a position of said notch of said bridge member, thereby when said trigger mechanism moving from said first trigger position to said second trigger position, said first protrusion of said switch being received by said notch.

11. The lid assembly as claimed in claim 1, in which, said second interaction means is provided at a lower portion of said spout; and said first interaction means is provided at said first portion of said trigger mechanism, wherein said trigger mechanism moving from said first trigger position to said second trigger position enabling said spout starts pivoting from said first spout position until said first interaction means interacting with said second interaction means, thereby said spout being maintained at said second spout position.

12. The lid assembly as claimed in claim 1, said lid assembly further comprising a cover, pivotably mounted to said first lid, is provided with a third interaction means; and a switch, movably connected to said second lid and is adjacent or adjacent to said cover, is provided with a fourth interaction means, wherein, said switch is configured:

a first position where said third interaction means not interacting with said fourth interaction means; and a second position where said third interaction means interacting with said fourth interaction means.

13. The lid assembly as claimed in claim 12, wherein said third interaction means is a cutout adjacent or adjacent to the pivot defined by the connection between said cover and said first lid; and said fourth interaction means is an arm portion of said switch dimensioned to be accommodated by said cutout.

14. The lid assembly as claimed in claim 13, in which, said lid assembly is provided with a first locking means on said switch, and a second locking means on said trigger mechanism, wherein:

when said switch in said first position, said first locking means interacting with said second locking means, thereby the movement of said trigger mechanism being limited;

when said switch in said second position, said first locking means not interacting with said second locking means, thereby said trigger mechanism is movable between said first trigger position and said second trigger position.

15. The lid assembly as claimed in claim 12, wherein:

when said switch being at said first position and said trigger mechanism being at said second trigger position, said spout being maintained at said first spout position; and when said switch being at said second position and said trigger mechanism being at said second trigger position, said spout being at said second spout position.

16. The lid assembly as claimed in claim 12, wherein the top surface of said second lid is provided with a fifth protrusion for assisting said switch maintained in said second position, whereby allowing said third interaction means aligned with said fourth interaction means.

17. The lid assembly as claimed in claim 1, wherein the spout in said second configuration being positioned 30° to 60° upwards with respect to the spout in said first configuration.

18. The lid assembly as claimed in claim 1, wherein the spout in said third configuration being formed an angle≥90° with respect to the spout in said first configuration.

19. The lid assembly as claimed in claim 1, wherein the spout in said third configuration being formed an obtuse with respect to the spout in said first configuration.

20. The lid assembly as claimed in claim 1, wherein said lid assembly is designed to operate the pivoting of said spout from said first spout position to said second spout position then to said third spout position.

21. The lid assembly as claimed in claim 1, wherein said second lid is provided with an air channel in fluid communication between an internal cavity of said container and the atmosphere, said air channel is operationally openable and closable with said trigger mechanism.

22. The lid assembly as claimed in claim 21, wherein:

when said trigger mechanism being in the first trigger position, said air channel being closed; and when said trigger mechanism being in the second trigger position, said air channel being opened.

23. The lid assembly as claimed in claim 22, wherein said channel is operationally opened before said lid assembly in said second configuration.

24. The lid assembly as claimed in claim 21, wherein:

said air channel comprising a first end in fluid communication with the atmosphere and a second end in fluid communication with the internal cavity of said container;

said trigger mechanism comprising a receptacle for receiving a plug for removably engaging with said first end of said air channel.

25. The lid assembly as claimed in claim 24, wherein:

when said trigger mechanism being in the first trigger position, said plug abutting against said first end of said air channel to close thereof; and when said trigger mechanism being in the second trigger position, said plug being away from said first end of said air channel to open thereof.

26. The lid assembly as claimed in claim 21, wherein said channel is operationally opened before said lid assembly in said second configuration.

* * * * *